US005709537A

United States Patent [19]

Maruyama et al.

[11] Patent Number: 5,709,537

[45] Date of Patent: Jan. 20, 1998

[54] EVACUATING APPARATUS

[75] Inventors: Teruo Maruyama, Hirakata; Akira Takara, Higashiosaka; Yoshikazu Abe, Neyagawa; Yoshihiro Ikemoto, Katano, all of Japan

[73] Assignee: Matsushita Electric Industrial Co., Ltd., Osaka-fu, Japan

[21] Appl. No.: 466,981

[22] Filed: Jun. 6, 1995

Related U.S. Application Data

[62] Division of Ser. No. 114,309, Sep. 2, 1993, Pat. No. 5,564,907.

[30] Foreign Application Priority Data

Sep. 3, 1992 [JP] Japan ..... 4-235551

[51] Int. Cl.[6] ..... F04B 35/04

[52] U.S. Cl. ..... 417/410.4; 417/42; 417/45; 418/9; 418/201.1

[58] Field of Search ..... 418/201.1, 9; 417/42, 417/45, 247, 244, 410.4

[56] References Cited

U.S. PATENT DOCUMENTS

| | | | |
|---|---|---|---|
| 3,515,164 | 6/1970 | Dunnous . | |
| 3,807,911 | 4/1974 | Caffrey | 418/9 |
| 4,068,984 | 1/1978 | Spindler . | |
| 4,504,201 | 3/1985 | Wycliffe . | |
| 4,792,294 | 12/1988 | Mowli . | |
| 5,040,949 | 8/1991 | Crinquette et al. . | |
| 5,197,861 | 3/1993 | Maruyama et al. | 417/42 |
| 5,295,798 | 3/1994 | Maruyama et al. . | |
| 5,374,173 | 12/1994 | Maruyama et al. . | |

FOREIGN PATENT DOCUMENTS

| | | | |
|---|---|---|---|
| 0 340 685 | 8/1989 | European Pat. Off. . | |
| 0 401 741 | 12/1990 | European Pat. Off. . | |
| 0 435 291 | 3/1991 | European Pat. Off. . | |
| 0 472 933 | 4/1992 | European Pat. Off. . | |
| 981.576 | 7/1951 | France . | |
| 38 28 608 | 8/1990 | Germany . | |
| 237384 | 9/1989 | Japan | 418/9 |
| 111690 | 5/1991 | Japan | 418/9 |
| 4031685 | 2/1992 | Japan | 418/9 |
| 5-272478 | 10/1993 | Japan . | |
| 1820035 | 6/1993 | U.S.S.R. | 418/201.1 |
| 1 248 032 | 9/1971 | United Kingdom . | |

*Primary Examiner*—Charles G. Freay
*Attorney, Agent, or Firm*—Wenderoth, Lind & Ponack

[57] ABSTRACT

An evacuating apparatus includes a first pump section disposed on a suction opening side, a second pump section for exhausting a smaller amount of gas than the first pump section, the second pump being disposed in an exhaust opening side, a plurality of rotors accommodated in a housing, bearings for supporting rotation of the rotors, a suction opening for drawing fluid and a first exhaust opening thereof both formed on the housing, and a plurality of motors for driving the rotors. In the apparatus, the first pump section is a pump of positive displacement type formed by utilizing a volume change of a space defined by the rotors and the housing, and the second pump section is a viscous-type pump formed by utilizing a relatively moving surface formed in a small gap defined between the rotors and the housing.

15 Claims, 25 Drawing Sheets

EVACUATING APPARATUS

This is a divisional application of Ser. No. 08/114,309, filed Sep. 2, 1993, now U.S. Pat. No. 5,564,907.

BACKGROUND OF THE INVENTION

The present invention relates to a vacuum pump used to exhaust from a vacuum chamber of semiconductor-manufacturing equipment.

A vacuum pump for generating a vacuum environment is essential to a CVD apparatus, a dry etching apparatus, a sputtering apparatus and the like to be used in a process for manufacturing semiconductors. The demand for a vacuum pump having improved performance has been growing greater and greater in recent years in correspondence with highly integrated and fine semiconductor-manufacturing processes. The vacuum pump is required to provide a high degree of vacuum, be clean, compact, and easy to perform maintenance on.

With the development of a composite semiconductor-manufacturing process, a so-called multi-chamber system in which each of a plurality of vacuum chambers is separately evacuated is mainly employed in semiconductor-manufacturing equipment. Accordingly, the number of vacuum pumps to be used in semiconductor-manufacturing equipment is increasing.

In order to comply with the demand for the improved evacuating system of the semiconductor-manufacturing equipment, a roughing dry vacuum pump is widely used instead of a conventional oil-sealed rotary vacuum pump so as to obtain cleaner vacuum. But the oil-sealed rotary vacuum pump has the following disadvantages:

(A) A great amount of energy is consumed;

(B) A large amount of noise and vibration is generated; and (C) The degree of ultimate vacuum pressure is insufficient.

Firstly, a detailed description of the above disadvantage (A) is set forth below.

The operation period of time of the vacuum pump used in the semiconductor-manufacturing equipment is divided into the following two processes:

(Process 1) Period of time required to exhaust a large amount of gas inside a vacuum chamber; and (Process 2) Period of time required to maintain a vacuum pressure which has been attained.

The ratio of the period of time of process 2 to that of process 1 is very large. Since the vacuum pump does not carry out the work of transporting gas in the process 2, no work is done by the vacuum pump in principle. However, the conventional vacuum pump consumes a great amount of power both in processes 1 and 2. Attention is paid to the reason a great amount of power is consumed in the process 2.

Referring to FIG. 4 showing the power consumed by the conventional screw type roughing pump with respect to the gas suction pressure, the following points (1) and (2) are noted.

Point (1): Consumed power is 4.0 KW when the suction pressure is in the vicinity of $10^3$ torr, i.e., when the vacuum pump starts exhausting gas of a great weight flow from a vacuum chamber.

Point (2): Consumed power is 3.2 KW when the suction pressure has dropped enough.

The ratio of the consumed power of the point (2) to the point (1) is approximately 80%. Much power which does not contribute to effective operations is wasted by tens or hundreds of dry vacuum pumps operating simultaneously in the semiconductor-manufacturing factory. The reason power is wasted is described below in detail by exemplifying a twin rotor type screw vacuum pump.

As shown in FIG. 28, the conventional twin rotor type screw vacuum pump (screw type with a thread groove) comprises two rotors 600*a* and 600*b* accommodated in a casing 602 and rotating in opposite directions with grooves 608*a* and 608*b* engaging each other. Gas is drawn from a suction opening 601 and discharged from an exhaust opening 602. The vacuum pump further comprises rotary shafts 603*a* and 603*b* integrally connected with the rotors 600*a* and 600*b;* ball bearings 605*a,* 605*b* and 606*a,* 606*b* for supporting the rotary shafts 603*a* and 603*b;* and timing gears 607*a* and 607*b* for obtaining synchronous rotation of the two rotors 600*a* and 600*b*. Normally, in this kind of dry pump, a delivery valve (check valve) is not formed in the exhaust opening 602 so as to reduce fluid resistance in the exhaust.

FIGS. 29A, 29B, and 29C are model views showing each process (N=0 through 4) of the suction, transporting, and exhaust of the above-described pump. The portions indicated by chain lines denote thread grooves 608*a* and 608*b* formed on the back surface which cannot be seen from the front. Reference symbols (S) (shown in FIGS. 29A, 29B, 29C, and 28) at the center and both edges denote portions to form sealing lines as a result of the engagement between the thread grooves of the rotors 600*a* and 600*b*. Accordingly, in the twin rotor type pump having thread grooves, a fluid-transporting space for transporting fluid from the suction side to the exhaust side is constituted by the sealing line (S), the thread grooves 608*a* and 608*b*, and the casing 602. Let it be supposed that the left half of the fluid-transporting space is denoted as n=1 through 5, and the right half thereof is denoted as n'=1 through 5. How the transporting space formed in the rotor 600*a* of the twin rotor transports fluid is described below with attention paid to the fluid-transporting space in the left half.

First process: N=0 shows the state in which the suction process has just started. Attention is paid to gas drawn from the suction side and accommodated in a groove of n=1 as shown by arrows in FIG. 29A.

Second process: Upon rotation of N=1, gas is moved to a groove of n=2 and enclosed in a space cut off from the suction side. The description of N=2, 3 is omitted herein.

Third process: Upon rotation of N=4, immediately after a part of a groove of n=5 communicates with the discharge side, gas on the high pressure discharge side flows back to the groove of n=5. Then, gas which has flowed into the groove of n=5 is exhausted to the exhaust side again with the progress of the entire process.

As described above, the reason a great power is required although the pressure on the suction side of the dry vacuum pump having no delivery valve (check valve) has reached a sufficiently low degree of vacuum is because the third process is included in the process.

The operation of the screw type vacuum pump to be performed after the rotation of N=4 is described below by replacing the screw type vacuum pump with a close coupled type pump. Referring to FIG. 30, the pump comprises a vacuum chamber 700; a cylinder 701; a fluid-transporting space 702 on the suction side of the pump; a fluid-transporting space 703 on the exhaust side thereof; a piston 704; a piston rod 705; a suction pipe 706; an exhaust pipe 707; an adsorption tower 708 for processing reactive gas; and a factory pipeline 709. The pressure in the fluid-transporting space 702 is sufficiently low and the pressure in the fluid-transporting space 703 is approximately atmospheric pressure ($P=1$ kg/cm$^2$). Accordingly, as shown in FIG. 30, in this process, the difference in pressure applied to the front and rear of the piston 704 is as large as approximately $\Delta P=1$ kg/cm$^2$. The piston 704 is required to move to the right against the pressure difference (external load). In this manner, energy which is not contributed to effective operations is lost. This disadvantage is common to positive displacement type vacuum pumps of although description has been made by way of example to the close coupled type pump.

It is conceivable to provide the vacuum pump with a delivery valve (check valve) as used in a compressor so as to prevent the back flow of gas from the exhaust side to the suction side in the exhaust process. But the following disadvantages arise.

The exhaust pressure of the vacuum pump is lower (close to atmospheric pressure) than that of the compressor and the volume flow rate of the vacuum pump is greater than that of the compressor.

A great exhaust amount (for example, equal to or more than 500 liter/min) is required in the semiconductor-manufacturing equipment. Because of the above disadvantages, it is necessary that the passage area of the delivery valve is sufficiently large when it is opened to the greatest extent. To this end, it is necessary to make the lift (moving amount) of the delivery valve sufficiently large, i.e., the use of a large delivery valve is required. A delivery valve having large lift has, however, a slow response. Thus, it is difficult to compose the delivery valve in conformity to a screw type vacuum pump, claw type vacuum pump or a scroll type vacuum pump. In addition, noise is increased by compound vibration of the delivery valve and fluid even though the delivery valve is provided, as previously described as the disadvantage (B).

SUMMARY OF THE INVENTION

Accordingly, an object of the present invention is to provide an evacuating apparatus capable of reducing an amount of energy to be consumed and noise and vibration, and capable of attaining a sufficient degree of ultimate vacuum pressure.

In accomplishing the object, according to a first aspect of the present invention, there is provided an evacuating apparatus comprising: a first pump section disposed in a suction opening side of a housing; a second pump section for exhausting a smaller amount of gas than the first pump section, the second pump being disposed in an exhaust opening side; a plurality of rotors accommodated in a housing; bearings for supporting rotation of the rotors; a fluid suction opening formed in the housing; an exhaust opening formed in the housing; and a driving means for driving the rotors, in which the first pump section is a pump of positive displacement type formed by utilizing a volume change of a space defined by the rotors and the housing, and the second pump section is a viscous-type pump formed by utilizing a relatively moving surface formed in a small gap defined between the rotors and the housing.

According to a second aspect of the present invention, there is provided an evacuating apparatus comprising: a first pump section disposed in a suction opening side; a second pump section for exhausting a smaller amount of gas than the first pump section, the second pump being disposed in an exhaust opening side of the housing; a plurality of rotors accommodated in a housing; bearings for supporting rotation of the rotors; a fluid suction opening formed in the housing; an exhaust opening formed in the housing; and a driving means for driving the rotors, in which each of the first and second pump sections is a positive displacement type pump formed by utilizing a volume change of a space defined by the rotors and the housing.

According to a third aspect of the present invention, there is provided an evacuating apparatus comprising: a first pump section disposed in a suction opening side of a housing; a second pump section for exhausting a smaller amount of gas than the first pump section, the second pump being disposed in an exhaust opening side of the housing; a plurality of rotors accommodated in the housing; bearings for supporting rotation of the rotors; a fluid suction opening formed in the housing; an exhaust opening formed in the housing; a plurality of motors for driving the rotors; and detecting means for detecting a rotational angle of each motor and a number of rotations thereof, in which the rotors are rotated synchronously in cooperation with the motors which independently drive the rotors, based on signals outputted from the detecting means, the first pump section is a pump of positive displacement type formed by utilizing a volume change of a space defined by the rotors and the housing, and the second pump section is a viscous-type pump formed by utilizing a relatively moving surface formed in a small gap defined between the rotors and the housing.

According to a fourth aspect of the present invention, there is provided an evacuating apparatus comprising: a first pump section disposed in a suction opening side of a housing; a second pump section for exhausting a smaller amount of gas than the first pump section, the second pump being disposed in an exhaust opening side of the housing; a plurality of rotors accommodated in the housing; bearings for supporting rotation of the rotors; a fluid suction opening formed in the housing; an exhaust opening formed in the housing; a plurality of motors for driving the rotors; and detecting means for detecting a rotational angle of each motor and a number of rotations thereof, in which the rotors are rotated synchronously in cooperation with the motors which independently drive the rotors, based on signals outputted from the detecting means, and each of the first and second pump sections is a positive displacement type pump formed by utilizing a volume change of a space defined by the rotors and the housing.

According to a fifth aspect of the present invention, the evacuating apparatus further comprises a third pump section formed of a screw thread or a vane for exhausting gas excising in an intermediate flow region and a molecular flow region and disposed on a shaft of at least one of the rotors.

According to a sixth aspect of the present invention, there is provided the evacuating apparatus in which the exhaust opening is formed on the exhaust side of the first pump section, and which further comprises: another exhaust opening formed ont he exhaust side of the second pump section; a connecting portion for connecting passages of the exhaust openings to each other; and a valve for opening and closing a passage disposed between the connecting portion and the exhaust opening formed on the exhaust side of the first pump section.

According to a seventh aspect of the present invention, there is provided the evacuating apparatus in which thread grooves engaging each other are formed on the rotors of the first pump section and the second pump section, and when a width of the thread groove formed on the first pump section is $B_1$ and a depth thereof is $h_1$; a width of the thread groove formed on the second pump section is $B_2$ and a depth thereof is $h_2$; and the widths $B_1$ and $B_2$ and the depths $h_1$ and $h_2$ are each an average value, respectively, the following equations are satisfied:

$$B_2 \geqq B_1; \text{ and}$$

$$h_1 \geqq h_2 .$$

According to an eighth aspect of the present invention, there is provided the evacuating apparatus in which the driving means comprises a motor for driving the first pump section and a motor for driving the second pump section which is driven independent of the motor for driving the first pump section.

According to a ninth aspect of the present invention, there is provided the evacuating apparatus in which the driving means comprises a motor for driving the rotors and timing gears for engaging each other, one of the timing gears being connected to the motor to synchronously rotate the rotors.

The vacuum pump comprises the first pump section providing a large amount of exhaust and the second pump section having a small amount of exhaust but providing a low degree of vacuum. The first pump section and the second pump section are connected to each other in series. The effect obtained by the first pump section and the second pump section independently formed is similar to that obtained by those connected in series. Immediately after the vacuum pump starts evacuation, the first pump section works efficiently and exhausts gas at a large weight flow rate. If the volume of the vacuum chamber connected with the upstream side of the vacuum pump is small, normally, the pressure inside the vacuum chamber drops to a sufficiently low degree of vacuum in less than several seconds. In this state, the second pump section communicates with the atmospheric side (exhaust side). Accordingly, torque to be determined by the exhaust amount (pressure-receiving area) is small.

A positive displacement type pump or viscous type pump can be used as the second pump section because a large exhaust amount is not required for the second pump section.

The first pump section can be composed of rotors of a thread groove type pump or rotors of a screw type pump, and then the rotors can be rotated synchronously by an electronic control means. In this manner, the rotors can be rotated at a high speed. As a result, internal leakage from the atmospheric side of the second pump section to the upstream side can be decreased, and consequently, the pressure in the downstream side of the first pump section can be kept at a low degree of vacuum. Therefore, the vacuum pump can be driven by a small torque.

Preferably, the valve can be formed in a portion intermediate between the first pump section and the second pump section and the exhaust opening can be formed. In this manner, gas can be exhausted from the vacuum chamber in a short period of time. In the state in which the vacuum pump has just started evacuation, the first pump section can exhaust gas in a large weight flow rate and gas can be exhausted from the first exhaust opening through the valve disposed at the portion intermediate between the first pump section and the second pump section. When the pressure on the suction side of the first pump section has reached a sufficiently low degree of vacuum, the valve can be closed and only the second exhaust opening disposed on the downstream side of the second pump section can communicate with the exhaust side disposed outside the vacuum pump. At this time, the pressure on the exhaust side of the first pump section can be at a sufficiently low degree of vacuum by the operation of the second pump section. Accordingly, greatly reduced power can suffice for driving the first pump section. In addition, since the exhaust amount of the second pump section is small, small power can be required for the exhaust. Therefore, greatly reduced power can suffice for driving the first and second pump sections.

In the above cases, the rotation of the first pump section can be equivalent to the rotation in vacuum. Therefore, unlike the conventional dry vacuum pump, gas can not flow back from the exhaust side to the suction side and hence a cyclic pulsation sound is not generated. In addition, the blade of the thread groove (screw) does not generate high noise during the high speed rotation of the rotor.

When the vacuum pump is driven by rotating the rotors synchronously by the above-described electronic control means, the timing gears (for example, 607*a* and 607*b* of FIG. 28) do not generate contact sound. Therefore, the cause of noise can be greatly reduced unlike the conventional roughing pump.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1A:
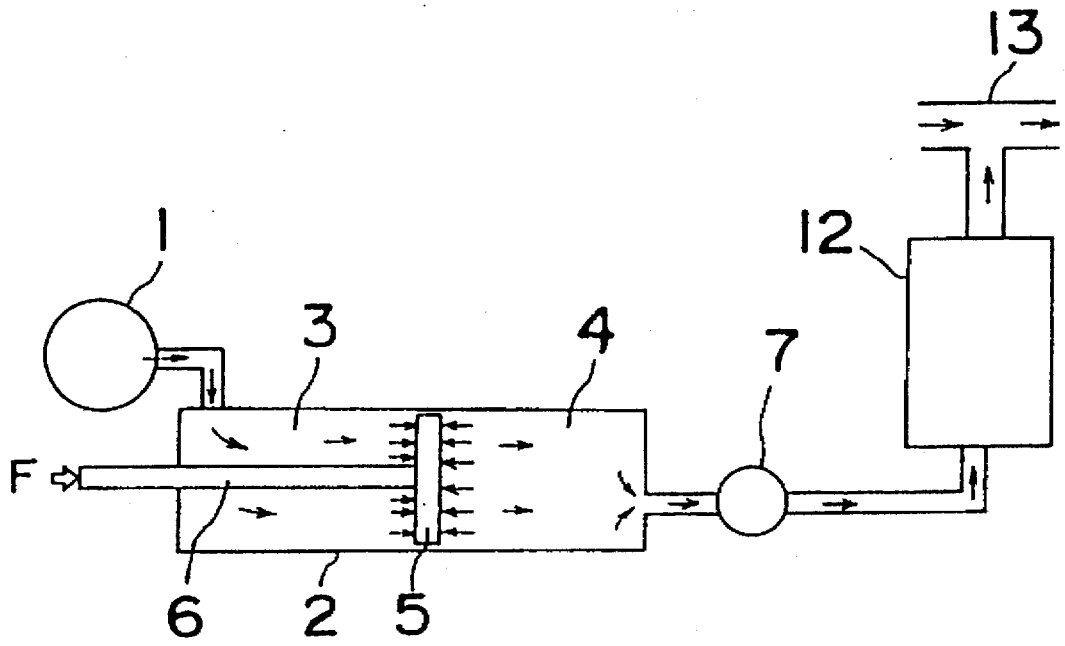
FIGS. 1A and 1B are views, showing the principle of a pump according to the present invention, in which a valve is not provided.

Before the description of the present invention proceeds, it is to be noted that like parts are designated by like reference numerals throughout the accompanying drawings.

Evacuating apparatuses according to embodiments of the present invention will be described below with reference to the drawings in the following order:

[1] Principle of the present invention;

[2] Thread groove (screw) pump as an evacuating apparatus according to a first embodiment;

[3] Example of application of an evacuating system including the evacuating apparatus according to the embodiment as applied to semiconductor-manufacturing equipment.

[1] Principle of the present invention

Regarding [1] the principle of the present invention, description is presented with respect to a case in which [1-I] a valve is not provided, and a case in which [1-II] a valve is provided.

[1-I] Case in which valve is not provided

Figure 1B:
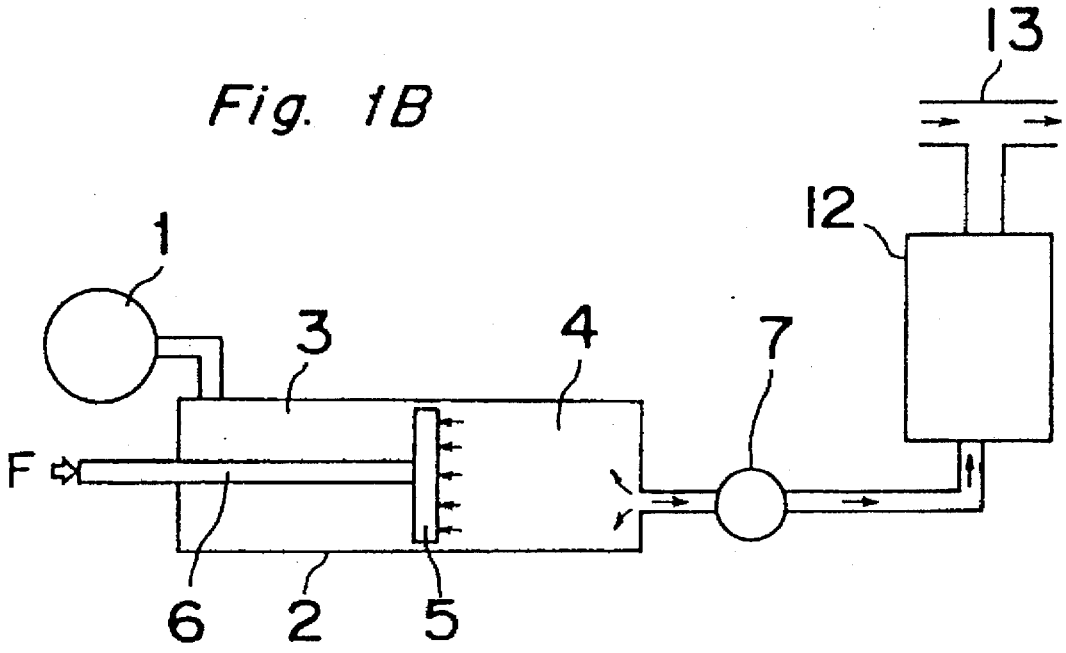

FIGS. 1A and 1B are model views showing a close coupled type vacuum pump constituting an evacuating apparatus according to this case. More specifically, FIG. 1A shows a state in which the exhaust of gas in a vacuum chamber has just started, and FIG. 1B shows a state in which the pressure in the vacuum chamber has reached a sufficiently low degree of vacuum. A first vacuum pump section in the vacuum pump is constituted by a vacuum chamber 1, a cylinder 2, a fluid-transporting space 3 in its suction side, a fluid-transporting space 4 in its exhaust side, a piston 5, and a piston rod 6. The evacuating apparatus comprises a second vacuum pump section 7 in the vacuum pump; an adsorption tower 12 for processing reactive gas; and a factory pipeline 13.

(1) State in which exhaust of gas in vacuum chamber has just started:

The first vacuum pump section draws a large amount of gas thereinto from the vacuum chamber 1 and the same amount of gas is exhausted from the exhaust side. At that time, since the exhaust volume of the second pump section 7 is small, the second pump section 7 is incapable of discharging a large amount of gas therefrom and thus the gas in the exhaust side (fluid-transporting space 4) of the second vacuum pump section 7 is compressed. Consequently, there is a possibility that the temperature of the second vacuum pump section 7 will rise. In a semiconductor-manufacturing process such as a dry etching process, the pressure in the vacuum chamber 1 attains a sufficiently low value in several seconds to several tens of seconds when the volume of the vacuum chamber of the vacuum pump of FIGS. 1 and 2 is 10 to 20 liters. Therefore, heat generated by compressed gas causes no practical problems in operation. Gas discharged from a micro-pump (second vacuum pump section 7) is transported to the factory pipeline 13 via the adsorption tower 12.

(2) State in which pressure in vacuum chamber has attained a sufficiently low degree of vacuum:

At this time, the weight flow of gas to be drawn from the vacuum chamber 1 into the first vacuum pump section is very small. When reactive gas having a pressure of approximately 1 atm is introduced into the vacuum chamber 1, the weight flow of the reactive gas to be drawn from the vacuum chamber 1 into the first vacuum pump section is as small as Q=50 to 150 cc/min.

The exhaust amount of the second vacuum pump section 7 is very small, while the second vacuum pump section 7 is constructed so that a sufficiently low ultimate vacuum can be obtained.

Accordingly, in the evacuating apparatus according to the present invention, gas hardly flows back from the exhaust side to the fluid-transporting space 4 in the exhaust process unlike the conventional pump. The pressure in the fluid-transporting space 4 is very low and the difference in the pressure between the front of the piston 5 and the rear thereof is slight. Accordingly, the energy loss of the first vacuum pump section can be reduced greatly.

[1-II] Case in which valve is provided

Figure 1C:
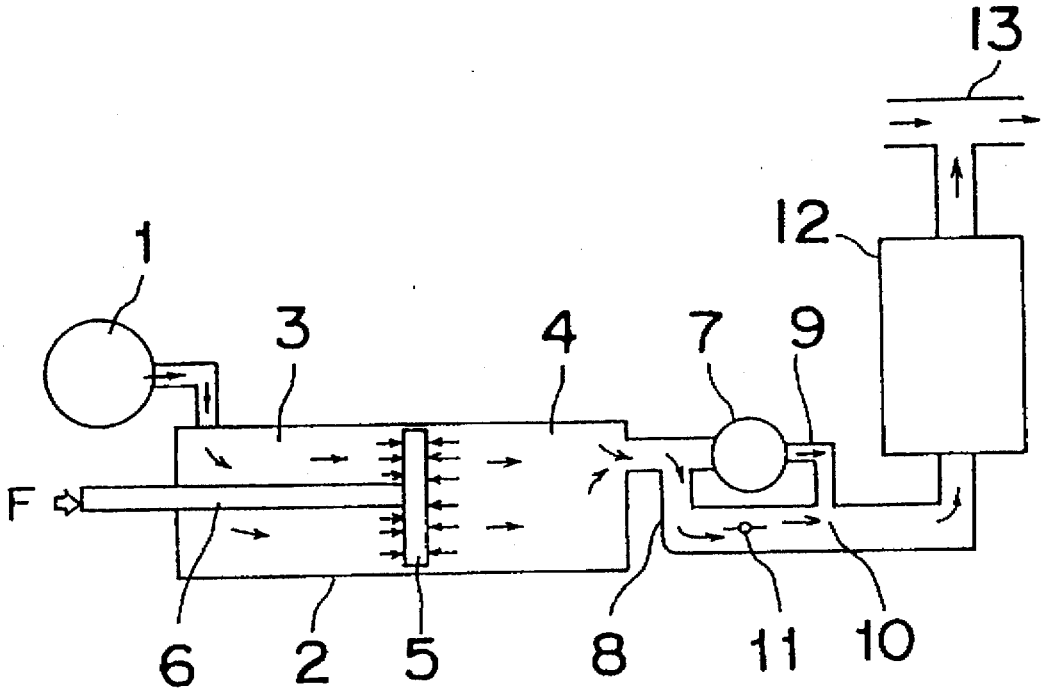
FIG. 1C is a view showing the principle of a pump according to the present invention, in which a valve is open.
Figure 1D:
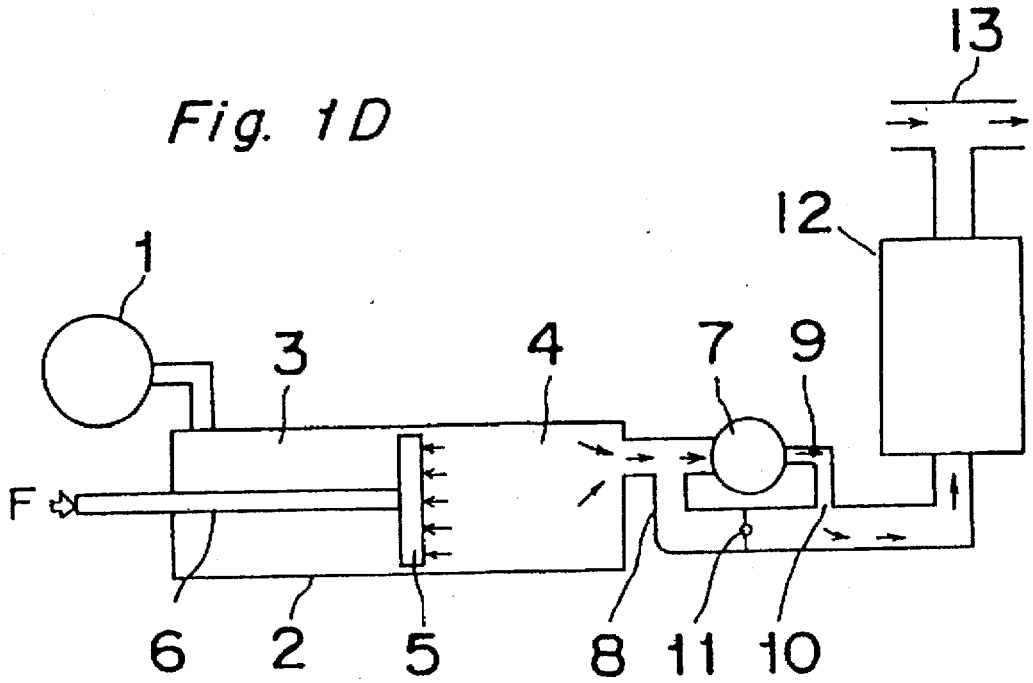
FIG. 1D is a view showing the principle of the pump in FIG. 1C, in which the valve is closed.
Figure 2:
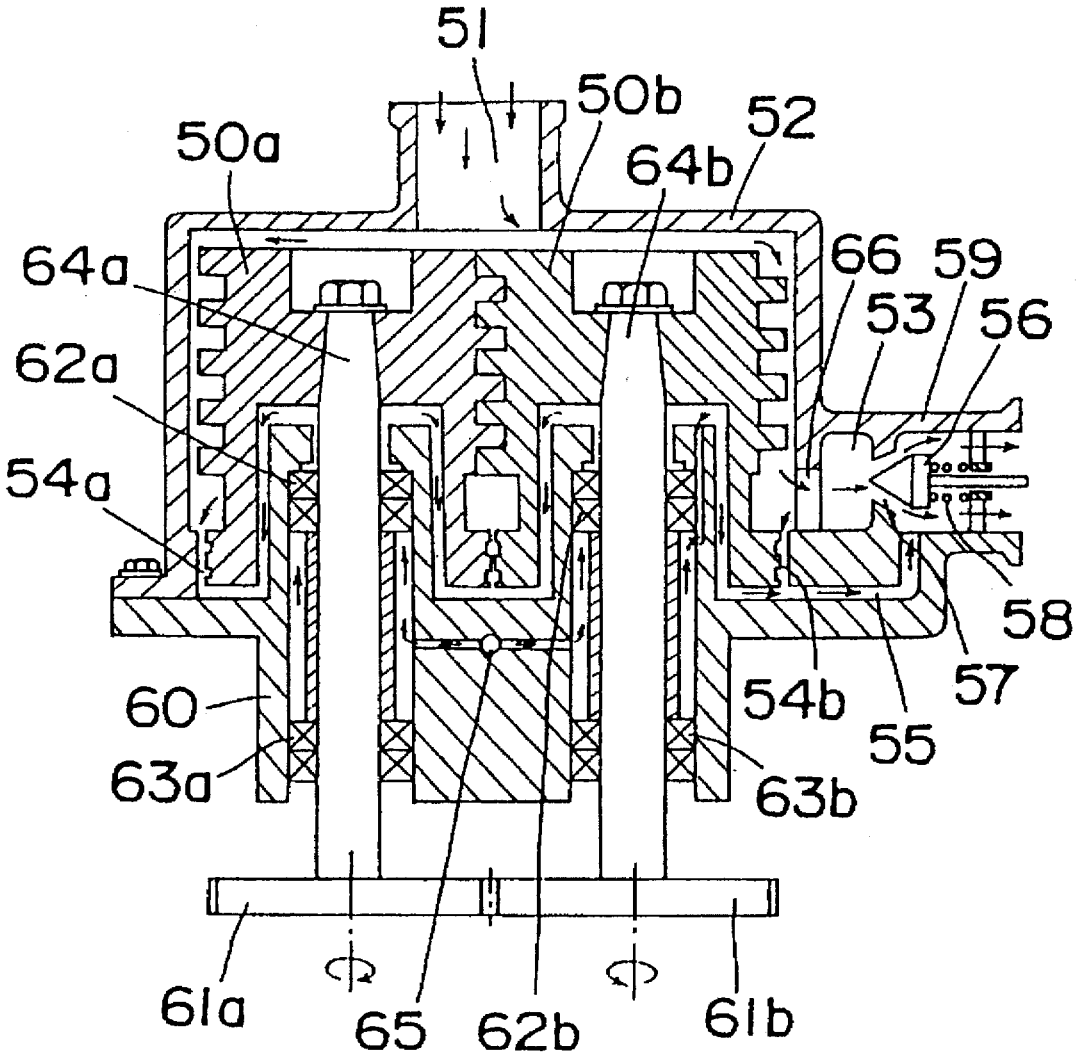
FIG. 2 is a view showing a pump according to a first embodiment of the present invention.

When the volume of the vacuum chamber 1 is large and thus when gas is to be exhausted in a very short period of time, in an evacuating apparatus of the second case, a valve 11 may be provided in parallel with the second pump section 7 as shown in FIGS. 1C and 1D. The other construction of the evacuating apparatus in FIGS. 1C and 1D is the same as that in FIGS. 1A and 1B. The principle of the present invention is the same as that of [1-I].

Referring to FIGS. 1C and 1D, the evacuating apparatus comprises a first exhaust passage 8 disposed between the first vacuum pump section and the second vacuum pump section 7, a second exhaust passage 9 disposed on the exhaust side of the second vacuum pump section 7, a connecting portion 10 for connecting the passages 8 and 9 with each other, and the valve 11 disposed in the first exhaust passage 8.

(1) State in which exhaust has just started:

The valve 11 is open and a large amount of gas is discharged through the valve 11 as shown in FIG. 1C.

(2) State in which pressure in vacuum chamber has reached a sufficiently low degree of vacuum:

The first exhaust passage 8 is closed by the valve 11. The second vacuum pump section 7 transports a slight amount of gas with a great pressure difference between its suction side and its exhaust side maintained.

As will be described later, a viscous-type pump or a screw pump having a shallow groove may be used as the second vacuum pump section 7. The exhaust amount of the second vacuum pump section 7 is smaller than that of the first vacuum pump section. Accordingly, a much smaller torque is sufficient for driving the second vacuum pump section 7 than the torque required to drive the first vacuum pump section. Thus, the evacuating apparatus of the present invention can be driven by a much smaller amount of power compared with the amount of power consumed by the conventional one.

[2] Thread groove (screw) pump as an evacuating apparatus according to a first embodiment The first embodiment is described below with reference to FIGS. 2, 3A, and 3B.

Figure 3A:
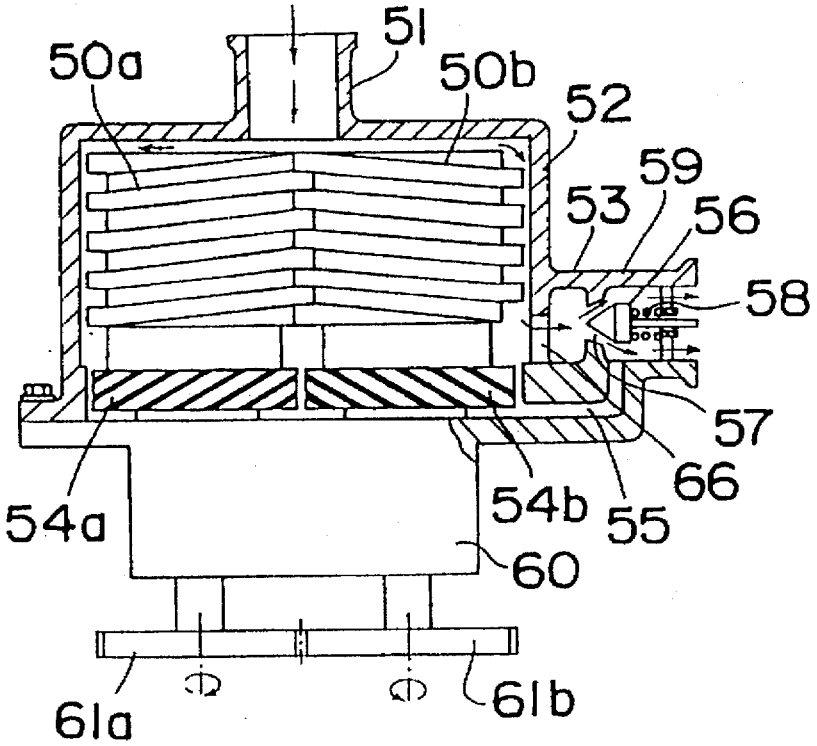
FIG. 3A is a sectional view, showing a pump according to the first embodiment of the present invention, in which a valve is open.
Figure 3B:
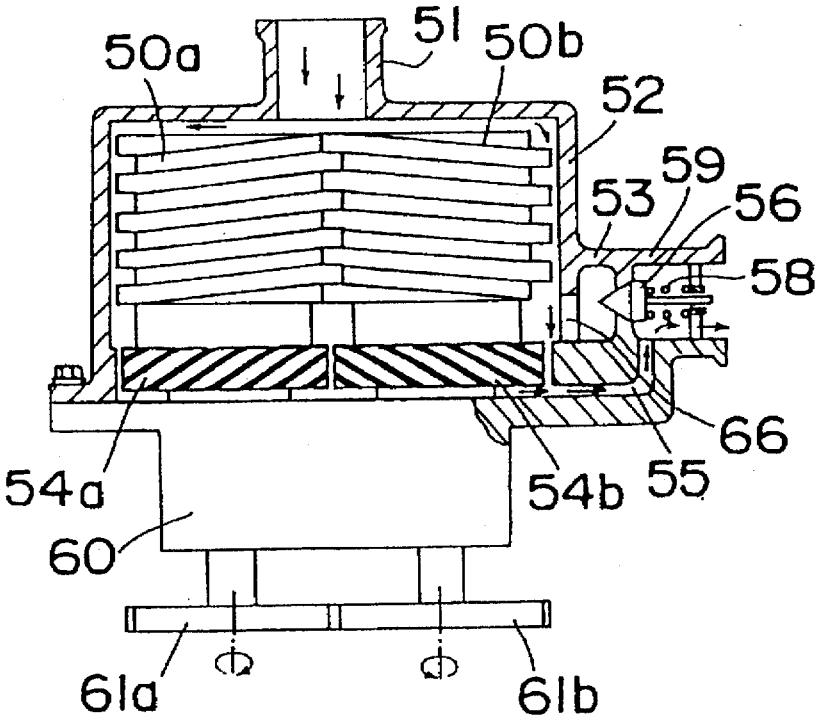
FIG. 3B is a sectional view, showing the pump according to the first embodiment of the present invention, in which the valve is closed.

FIG. 3A shows the state in which an exhaust has just started and a valve is open. FIG. 3B shows the state in which the suction side of the vacuum pump, namely, the gas in a vacuum chamber has reached a sufficiently low degree of vacuum.

The evacuating apparatus comprises a positive displacement type screw pump (first pump section) which includes screw (thread groove) rotors **50*a* and 50*b*; a suction opening 51; a housing 52 for accommodating the rotors 50*a* and 50*b*; and a first exhaust opening 53**.

The evacuating apparatus further comprises viscous-type pumps (second vacuum pump section) **54*a* and 54*b* which have spiral grooves coaxial with each of the rotors 50*a* and 50*b*; a second exhaust opening 55 disposed on the exhaust side of the viscous-type pumps 54*a* and 54*b*; a spool 56 of a valve; an opening 57 of the valve; and a spring 58 for applying a load to the spool 56 in the axial direction thereof. A control valve 59 is constituted by the spool 56, the opening 57 and the spring 58. The evacuating apparatus further comprises: a lower housing 60 accommodating bearings 62*a*, 63*a* and 62*b*, 63*b* for supporting the rotation of each of the rotors 50*a* and 50*b*; rotary shafts 64*a* and 64*b* integrally connected with each of the rotors 50*a* and 50*b*; timing gears 61*a* and 61*b* for synchronously rotating the rotors 50*a* and 50*b*; an introducing portion 65 through which purge gas of $N_2$ is introduced from outside; and a gap 66** disposed on the exhaust side of the first vacuum pump section.

(1) State in which exhaust has just started:

The suction side communicating with the vacuum chamber (100 of FIG. 5 described later) is open to atmospheric air and thus the pressure of the gas at the suction side is on the same order as the atmospheric pressure. The gas introduced from the suction opening 51 and transported by the thread grooves of the rotors **50*a* and 50*b* is compressed to a small degree in the gap 66** disposed on the exhaust side of the first pump section.

The urging force of the spring 58 is set so that the control valve 59 is opened by the balance between the urging force of the spring 58 and the difference in pressure between the front of the spool 56 and the rear thereof when the pressure at the gap 66 is high. Accordingly, when gas having a sufficiently high density is transported, almost all gas flows to the outside via the first exhaust opening 53 as shown by arrows of FIG. 3A.

(2) State in which pressure in suction side has reached a low degree of vacuum:

At this time, the control valve 59 is closed because the pressure in the gap 66 has dropped. But gas existing in the gap 66 is discharged to the outside via the second exhaust opening 55, because the viscous-type pumps (second vacuum pump section) are always operating. When reactive gas and $N_2$ flow into the evacuating apparatus from the suction side of the first vacuum pump section, the flow rate thereof is on the order of at most Q=50 to 150 cc/min as described previously. The viscous-type pump is solely capable of exhausting them when they are so small in flow rate. Accordingly, the pressure on the exhaust side (the gap 66) of the screw pumps **50*a* and 50*b*** (first vacuum pump section) can be kept at a low value.

The windage loss of the viscous-type pump is smaller than that of a pump rotating non-circular rotors such as a screw pump, a claw pump, or the like when they are rotated because the groove depth of the viscous-type pump ranges from several microns to several tens of microns.

A small amount of power is consumed and low noise may be generated by setting the pressure on the exhaust side (the gap 66) of the screw pump to 0.2 to 0.3 kg/cm$^2$ in this embodiment. In order to prevent reactive gas from permeating into the bearing or the motor in purging $N_2$ gas, the pressure on the exhaust side (the gap 66) of the screw pump can be prevented from rising by forming the flowing passage so that purge gas of $N_2$ flows through the second exhaust opening 55 as shown in FIG. 2. In the vacuum pump according to this embodiment, once the control valve 59 is closed, the control valve 59 remains closed, whereas in a conventional delivery valve, the delivery valve is repeatedly opened and closed because even a slight amount of gas such as $N_2$ gas or reactive gas is transported under pressure to the exhaust side of the pump. As a result, noise is generated. In the present invention, the micropump (second pump section) exhausts a slight amount of $N_2$ gas or reactive gas continuously and smoothly. Therefore, the vacuum pump can be operated continuously for a long time with a very quiet state kept. It is unnecessary for the control valve 59 of this embodiment to have a high responsibility unlike a delivery valve of a compressor. In the conventional delivery valve, making the responsibility high is contradictory to making the area of the opening to open and close, whereas in this embodiment, it is easy to design the control valve 59 for securing the area of the opening. Further, in this embodiment, even though the exhaust side of the vacuum pump is suddenly opened to the atmospheric air, the spring 58 supporting the spool 56 of the valve contracts, so that the valve can be opened. In this manner, the vacuum pump can be prevented from being damaged in emergency.

Figure 4:
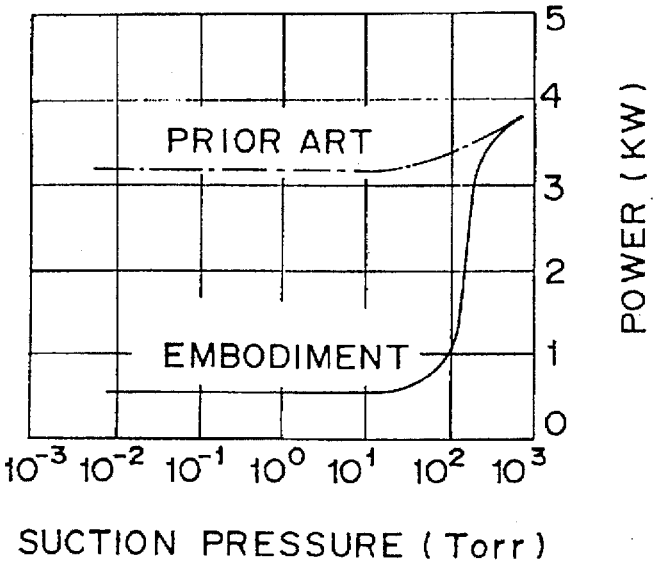
FIG. 4 is a graph showing the relationship between consumed power and intake pressure of a pump according to an embodiment of the present invention and a conventional pump.

FIG. 4 shows an example of the characteristics of power to be consumed relative to the pressure of gas drawn into the vacuum pump according to the embodiment in comparison with a vacuum pump according to the prior art.

Figure 5:
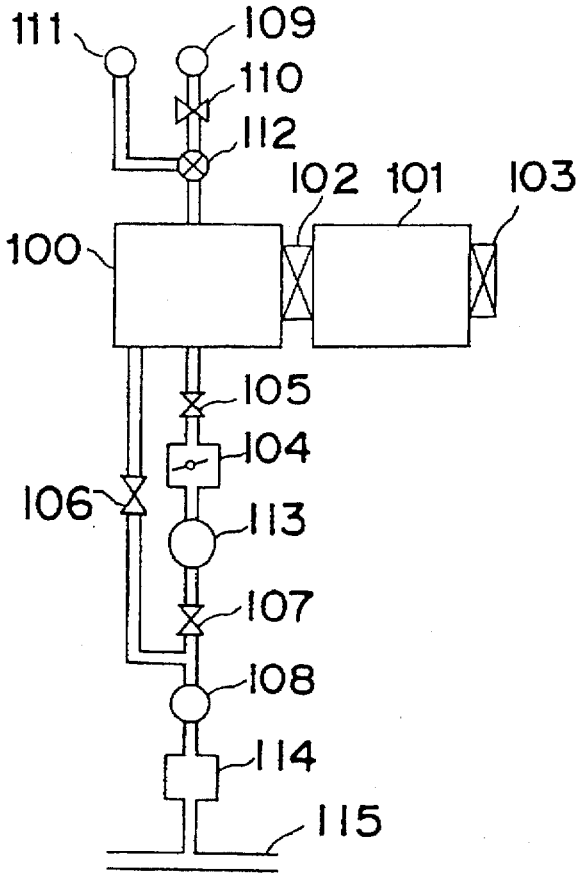
FIG. 5 is a view showing an evacuating system, including an evacuating apparatus according to the embodiment of the present invention, equipped in a semiconductor-manufacturing factory.

[3] Example of application of an evacuating system including the evacuating apparatus according to the embodiment to semiconductor-manufacturing equipment Referring to FIG. 5, an evacuating system comprises a vacuum chamber 100; a load-locking chamber 101; a gate 102 disposed between the vacuum chamber 100 and the load-locking chamber 101; a gate 103 disposed at the atmospheric air side of the load-locking chamber 101; a throttle valve 104; a first valve 105; a second valve 106; a third valve 107; a roughing vacuum pump 108 constituted as the evacuating apparatus according to the embodiment; a source 109 of reactive gas; a mass-flow controller 110; an $N_2$ gas source 111; a change-over valve 112; a turbo-molecular pump 113; an adsorption tower 114; and a factory pipeline 115. The operation of the evacuating system is as follows:

First process (1): When the operation of the apparatus starts, the gates 102 and 103 are cut off, and then the roughing pump 108 is operated to discharge gas inside the vacuum chamber 100 and in the load-locking chamber 101. The details of the evacuating system of the load-locking chamber 101 are not shown in FIG. 5. The second valve 106 is opened, with the third valve 107 cut off in this process.

Second process (2): When the pressure inside the vacuum chamber 100 has dropped sufficiently, the second valve 106 is closed and the third valve 107 is opened to drive the turbo-molecular pump 113 with the roughing pump 108 also being driven.

Third process (3): After the pressure in the vacuum chamber 100 reaches a predetermined degree of vacuum, a slight amount of $N_2$ gas is introduced into the vacuum chamber 100 so as to exhaust gas (including $H_2O$) remaining in the vacuum chamber 100 therefrom. The load-locking chamber 101 is evacuated similarly. Then, the gate 102 is opened to introduce a wafer into the vacuum chamber 100.

Fourth process (4): After the gates 103 and 102 are cut off, the reactive gas 109 is introduced into the vacuum chamber 100. The amount of gas is controlled by the mass-flow controller 110 while the pressure inside the vacuum chamber 100 is being detected. When the wafer has been processed, $N_2$ gas is introduced into the vacuum chamber 100 again to exhaust the reactive gas therefrom.

Fifth process (5): The gate 102 is opened to remove the wafer from the vacuum chamber 100 and return the wafer to the load-locking chamber 101.

As the production continues in the above-described process, the operation returns to the second process (2) from the fifth process (5) to repeat the production in the same manner. Loads are applied to the roughing pump 108 in the above-described process as follows:

The roughing pump 108 transports a great amount of gas only in the first process (1), namely, only in the stage of exhausting air inside the vacuum chamber 100 therefrom. The first process (1) is completed for several seconds.

In the stage after the second process (2) is completed, namely, in the stage in which the turbo-molecular pump 113 and the roughing pump 108 are simultaneously used, the roughing pump 108 is used to drop the pressure on the exhaust side of the turbo-molecular pump 113, and gas to be transported is slight in quantity. The quantity of $N_2$ gas and reactive gas to be transported in the second to fourth processes (2), (3), and (4) is as slight as Q=50 to 150 cc/min.

Accordingly, as described above, in the semiconductor-manufacturing process, the ratio of the period of time in which the roughing pump 108 transports gas having a high density to the total operation period of time of the evacuating apparatus is slight. In most cases, the roughing pump is used to maintain the pressure difference between the atmospheric air and the pressure in the vacuum chamber or reduce the pressure in the exhaust side of the turbo-molecular pump disposed in an upper stage. As described previously, with the adoption of the multi-chamber method (evacuation in each vacuum chamber) in semiconductor-manufacturing equipment in recent years, the number of vacuum pumps to be used in semiconductor-manufacturing equipment is increasing, and an amount of gas being exhausted from the vacuum pump is increasing. The vacuum pump according to the present invention can save a great amount of energy in semiconductor-manufacturing.

Second Embodiment

Figure 6:
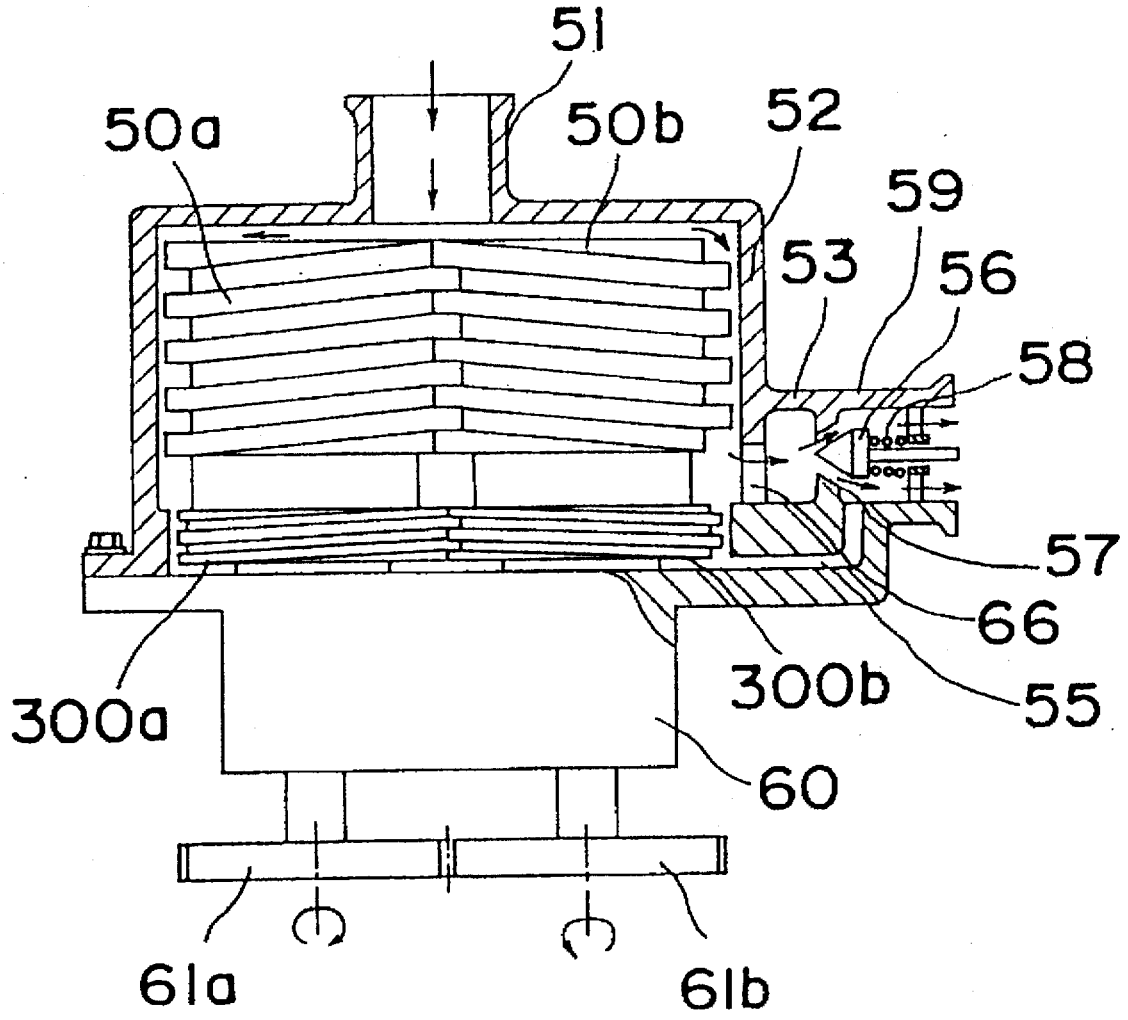
FIG. 6 is a sectional view showing a screw type micro-pump according to a second embodiment of the present invention.

The second embodiment of the present invention is described below with reference to FIG. 6. In the second embodiment, instead of a viscous-type pump, a screw (thread groove) pump of positive displacement type is used as the second pump section. Micro-screws 300*a* and 300*b* engaging each other are formed on the rotors 50*a* and 50*b*. The width and depth of a groove formed on each of the micro-screws 300*a* and 300*b* of the rotors 50*a* and 50*b* are small. The torque for driving the screw pump is proportional to an exhaust volume determined by the depth and width of the groove. Therefore, a small torque suffices for driving the second pump section in the second embodiment and thus power for driving the second pump section can be greatly reduced in a steady operation.

Third Embodiment

In the first and second embodiments, a large volume of gas in the vacuum chamber is exhausted in a short period of time.

Figure 7A:
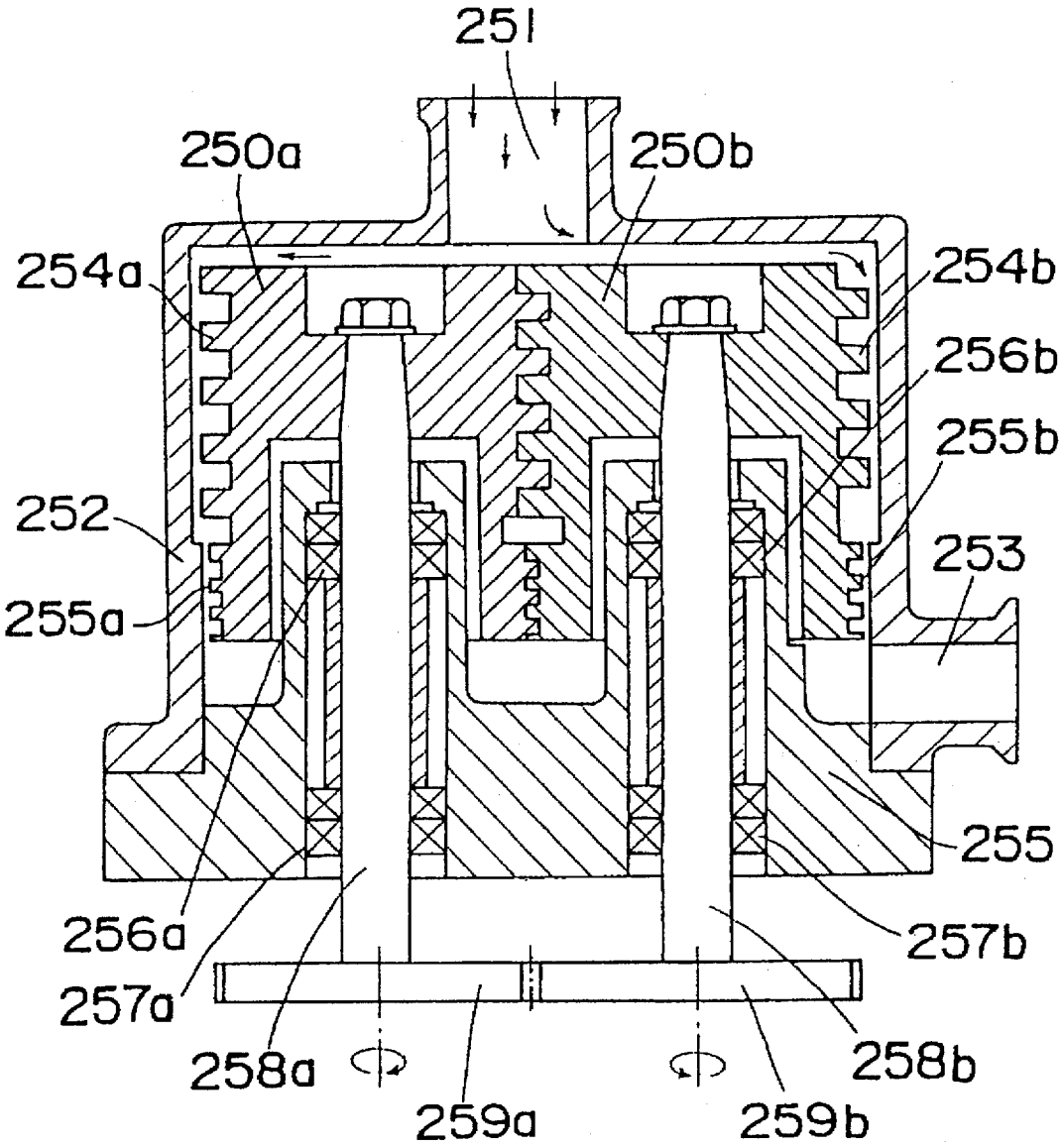
FIG. 7A is a sectional view showing a vacuum pump, according to a third embodiment of the present invention, in which valve is not provided.

If the volume of the vacuum chamber is sufficiently small, it is unnecessary to provide the evacuating apparatus with the valve (59 of FIG. 2) and the first exhaust passage (53 of FIG. 2) between the first pump section and the second pump section. This is because if the volume of the vacuum chamber is small, it is possible to allow the pressure inside the vacuum chamber to reach a sufficiently low degree of vacuum in a short period of time by exhausting gas from only the second exhaust opening. Immediately after the exhausting starts, drawn gas is compressed when the gas passes through the second pump section. But there is no practical problem so long as the gas passes through the second pump section in a short period of time. As shown in FIG. 7A, the evacuating apparatus according to the third embodiment comprises rotors 250*a* and 250*b* each having a screw (a thread groove); a suction opening 251; a housing 252 accommodating the rotors 250*a* and 250*b;* an exhaust opening 253; and thread grooves 254*a* and 254*b* formed on each of the rotors 250*a* and 250*b*.

Thread grooves 255*a* and 255*b* each having a small screw area and engaging each other are formed in the vicinity of the exhaust opening 253 of each of the rotors 250*a* and 250*b*, thus constituting a positive displacement type micro-screw.

The vacuum pump further comprises a lower housing 255 accommodating bearings 256*a*, 257*a* and 256*b*, 257*b* for supporting each of the rotors 250*a* and 250*b;* rotary shafts 258*a* and 258*b* integrally connected with each of the rotors 250*a* and 250*b;* and timing gears 259*a* and 259*b* for synchronously rotating the rotors 250*a* and 250*b*.

Fourth Embodiment

Figure 8A:
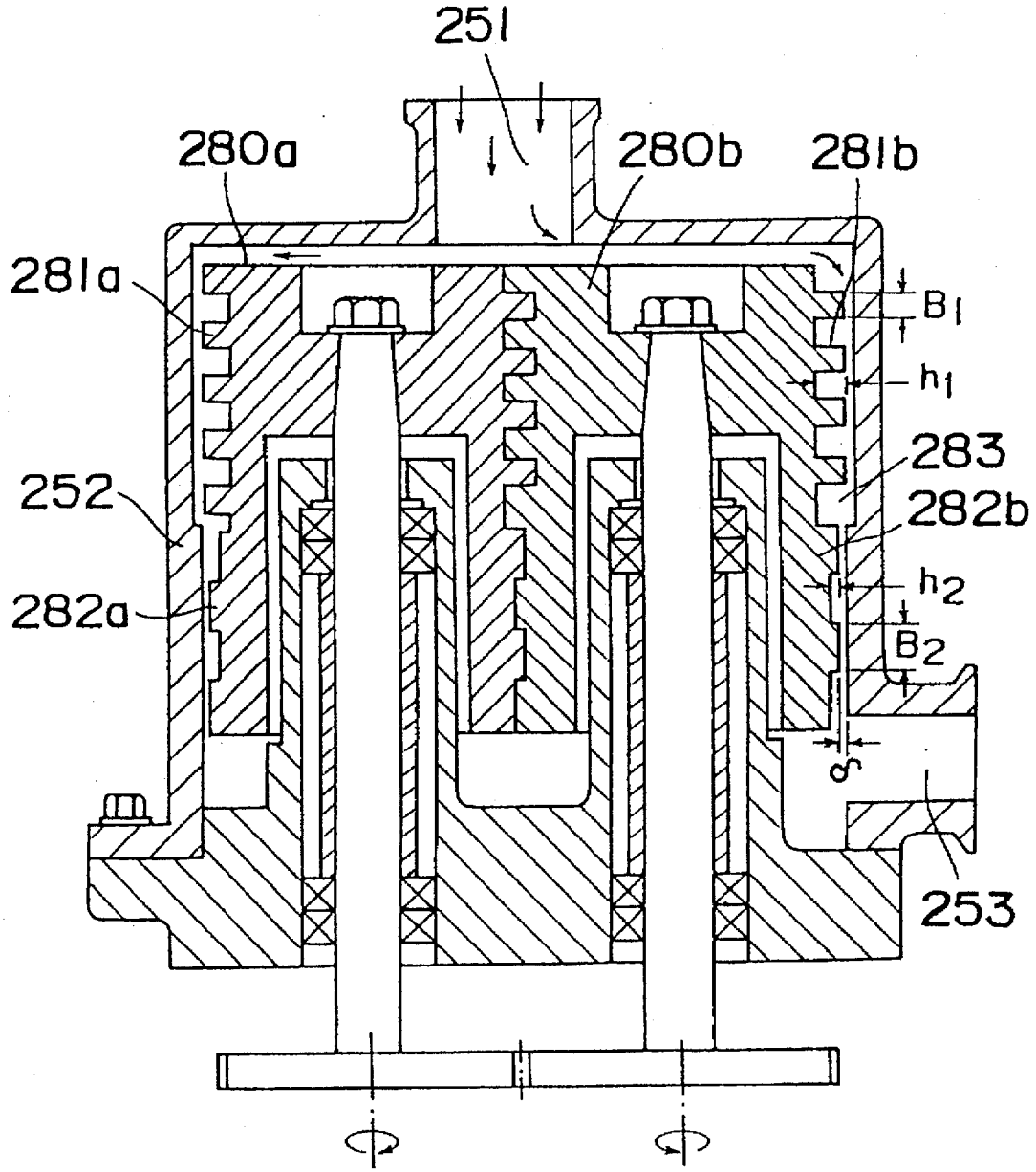
FIG. 8A is a sectional view showing a vacuum pump, according to a fourth embodiment of the present invention, in which screw rotors are provided to reduce internal leakage of fluid.

An evacuating apparatus according to the fourth embodiment is described below with reference to FIGS. 8A and 9A. In the fourth embodiment, the sealing performance of the pump (second pump section) on the downstream side of the vacuum pump is improved to operate the vacuum pump with a smaller torque.

The vacuum pump comprises screw rotors 280*a* and 280*b;* thread grooves 281*a* and 281*b* disposed in the upstream side of the rotors 280*a* and 280*b;* and thread grooves 282*a* and 282*b* disposed in the downstream side of the rotors 280*a* and 280*b*. The thread grooves 281*a* and 281*b* and the housing 252 constitute a first pump section.

The housing 252 and the thread grooves 282*a* and 282*b* constitute a positive displacement type micro-screw (second pump section), the groove of which has a great width and the smallest depth possible.

Figure 9A:
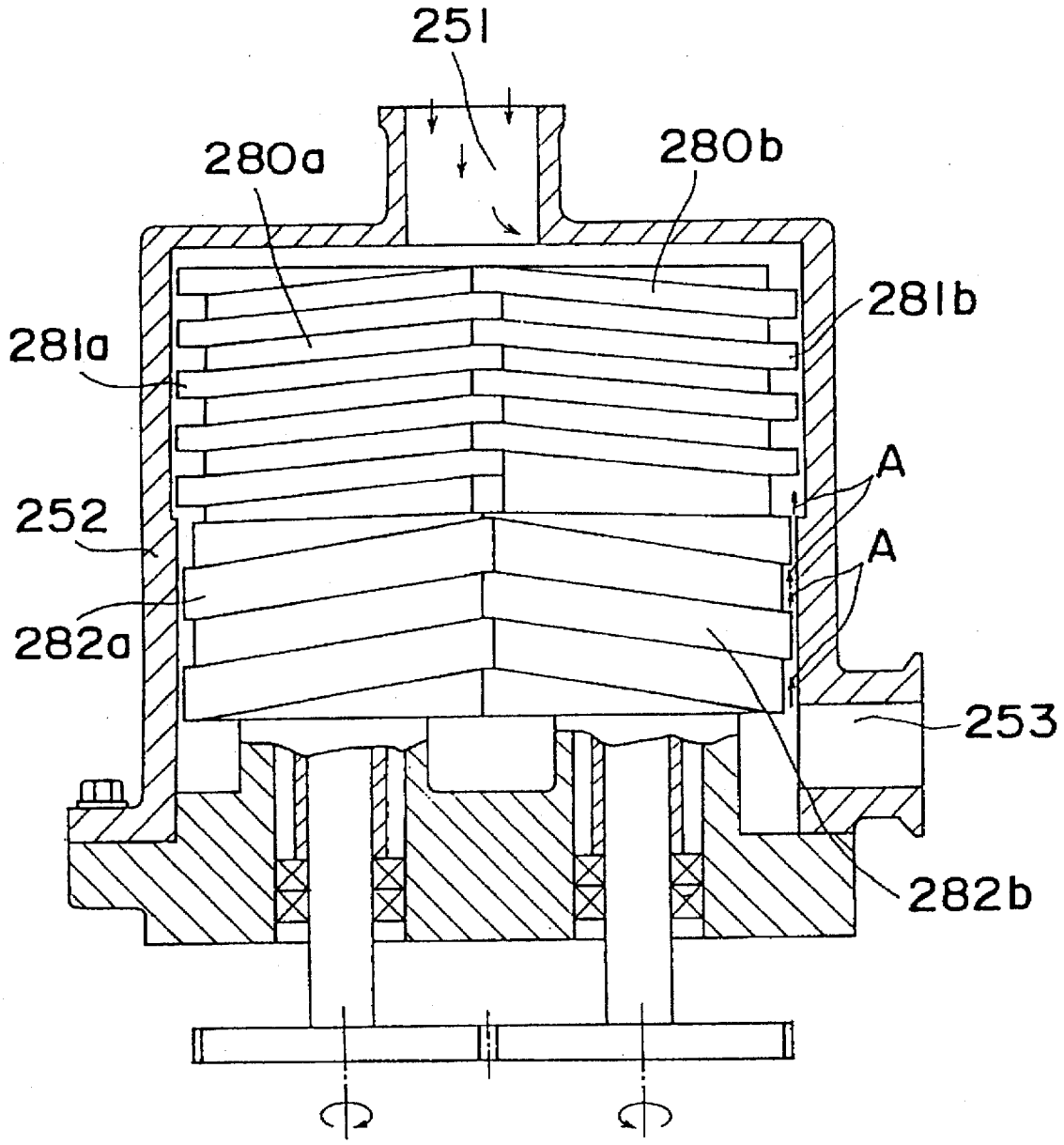
FIG. 9A is a partial sectional view, of the vacuum pump of FIG. 8A.

In order to operate the vacuum pump by a small torque, the lowest pressure possible is preferably set in an intermediate portion 283 disposed at the upstream of the second pump section. To reduce the pressure in the intermediate portion 283, it is necessary to carry out either a first method {1} or a second method {2} described below:

{1} Increase the exhaust capacity of the second pump section;

{2} Decrease the back-flow from the exhaust side to the upstream side (shown by an arrow "A" of FIG. 9A).

In the case of the first method {1}, since exhaust volume is proportional to torque, the first method {1} is ineffective for achieving the above-described object. Therefore, the second method {2} is effective in this embodiment.

Supposing that the inner diameter of the housing accommodating the rotors is d; the gap between the housing and the rotors is δ; the width of the convex portion of the groove is B; the viscosity coefficient of gas is μ; and the difference in pressure between the upstream side and the downstream side is Δ, internal leakage Q is found by the following equation (1).

$$Q=\frac{\pi d\delta^3}{12\mu B} \tag{1}$$

The internal leakage Q is decreased by reducing the gap δ. But in the vacuum pump, it is necessary to consider the thermal expansions, centrifugal expansion, processing, assembly accuracy of components, and the like, and thus such decrease has a limitation. In this embodiment, the internal leakage Q is reduced by increasing the width B of the thread groove. That is, the configuration of the groove is determined so that the following condition holds, supposing that the width of the convex portion of the groove of the first pump section is $B_1$ and the depth of the groove is $h_1$, and the width of the convex portion of the groove of the second pump section is $B_2$ and the depth of the groove is $h_2$.

$$B_2 \geqq B_1 \tag{2}$$

$$h_1 \geqq h_2 \tag{3}$$

From equations (2) and (3), a sealing effect can be obtained if the gap between the rotors and the housing is sufficiently great. Therefore, the vacuum pump can be driven by a smaller torque.

Fifth Embodiment

In an evacuating apparatus according to the fifth embodiment, the first pump section and the second pump section are not independently operated, but the volume of the fluid-transporting space formed by the two rotors and the housing decreases continuously toward the exhaust side of the evacuating apparatus.

Figure 7B:
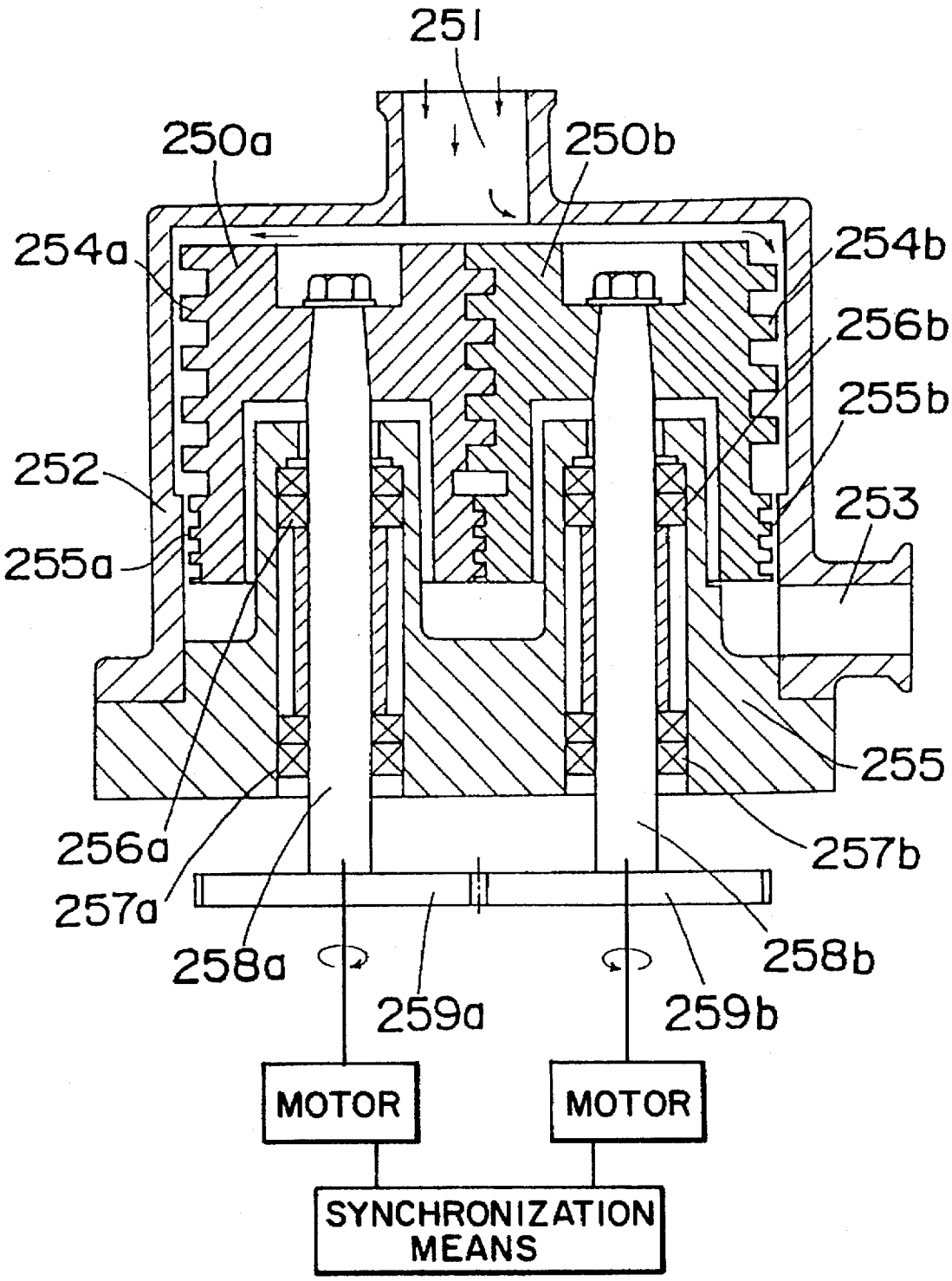
FIG. 7B is a view similar to FIG. 7A but showing the vacuum pump provided with electronic synchronization.
Figure 10:
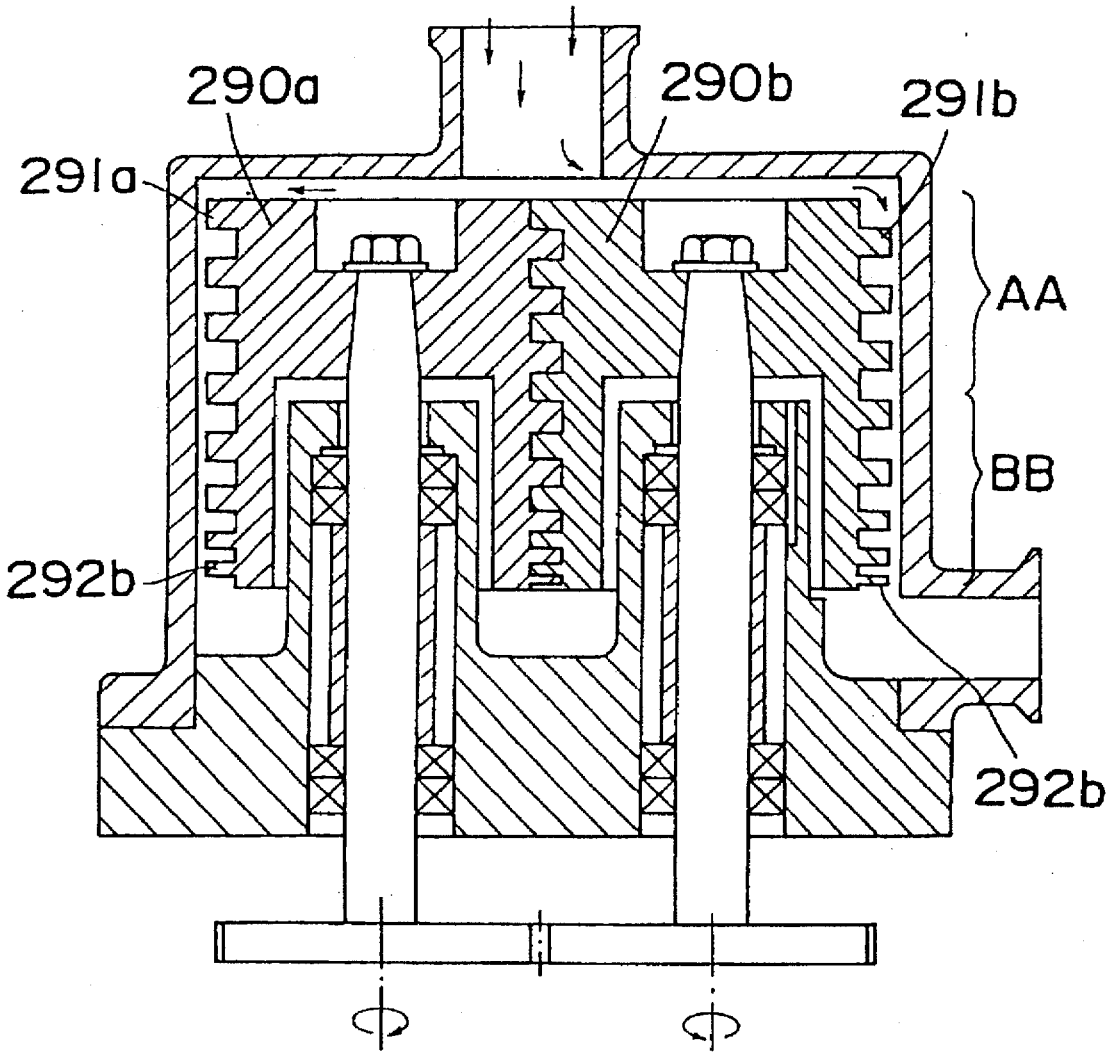
FIG. 10 is a sectional view showing a vacuum pump, according to a fifth embodiment of the present invention, in which the pitch of a thread groove gradually decreases toward a downstream side.

The vacuum pump comprises rotors 290*a* and 290*b* with thread grooves; thread grooves 291*a* and 291*b* disposed in the upstream side of the rotors 290*a* and 290*b;* and thread grooves 292*a* and 292*b* disposed in the downstream side of the rotors 290*a* and 290*b*. The pitch of the thread groove becomes gradually smaller toward the exhaust side. The exhaust capability (exhaust capacity) of gas is determined by the configuration of the thread grooves 291*a* and 291*b* disposed in the upstream side of the rotors 290*a* and 290*b*. The flow rate of re-expanded gas which gives a great influence on torque is determined by the configuration of the thread grooves 292*a* and 292*b* disposed on the downstream side of the rotors 290*a* and 290*b*. The principle and effect of this embodiment is fundamentally the same as those of the embodiment of FIG. 7. In order to distinguish the first pump section and the second pump section clearly from each other, the upper half (AA of FIG. 10) of the rotor is defined as the first pump section and the lower half thereof (BB of FIG. 10) is defined as the second pump section.

Sixth Embodiment

Figure 11:
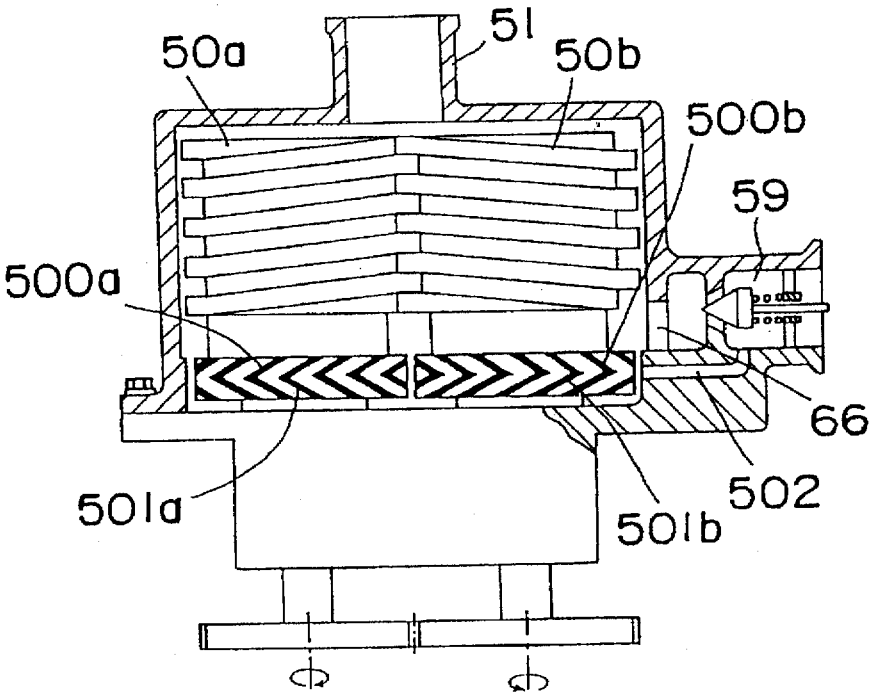
FIG. 11 is a partial sectional view showing a vacuum pump according to a sixth embodiment of the present invention, which is similar to the third embodiment but includes a third pump section.
Figure 12:
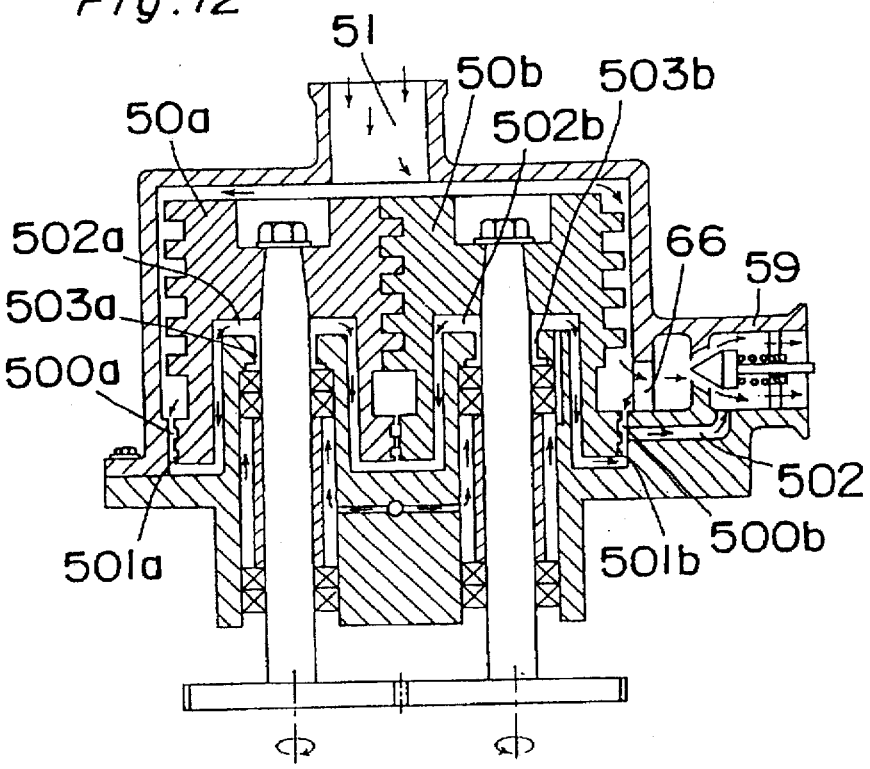
FIG. 12 is a sectional view showing the vacuum pump according to the sixth embodiment.

In an evacuating apparatus according to the sixth embodiment shown in FIGS. 11 and 12, a sub-pump is provided in addition to the first and second pump sections to reduce a thrust load to be applied to the bearing. In this manner, the loss relating to the sliding contact between the rotors and the bearings is reduced to operate the rotors with a small torque. The evacuating apparatus comprises second pump sections 500*a* and 500*b;* sub-pumps 501*a* and 501*b;* a second exhaust opening 502, the opening of which is intermediate between the second pump section and the sub-pump; and sealing portions 503*a* and 503*b* formed in spaces provided insides of the rotors.

Similarly to the above-described embodiments, each second pump section 500*a*, 500*b* transports gas under pressure from the exhaust side 66 of the first pump section to the second exhaust opening 502, whereas each sub-pump 501*a*, 501*b* transports gas under pressure in the direction opposite to the direction in which the second pump section 500*a*, 500*b* transports the gas. That is, the sub-pumps 501*a*, 501*b* operate so that gas existing in inner spaces 502*a* and 502*b* of the rotors 50*a* and 50*b* is exhausted therefrom. It is necessary to design the bearing of the screw type vacuum pump in consideration of a remarkably large load (capacity) to be applied thereto. The radial load to be applied to the bearing is not as great as the thrust load to be applied thereto, the thrust load being remarkably large. This is because the difference between pressures applied to the upper and lower end surfaces of the rotor perpendicular to the shaft thereof causes the thrust load to be applied to the rotor. The reason is as follows: Supposing that $\Delta P = 1$ kg/cm$^2$ and the diameter of the rotor is 10 cm, a thrust load of F=78.5 kgf is applied to the bearing. In the sixth embodiment, each sub-pump 501*a*, 501*b* is capable of generating a low pressure in the inner space of each rotor 50*a*, 50*b* and, as a result, the loss relating to the sliding contact between the rotor and the bearing can be greatly reduced.

Seventh Embodiment

Figure 13:
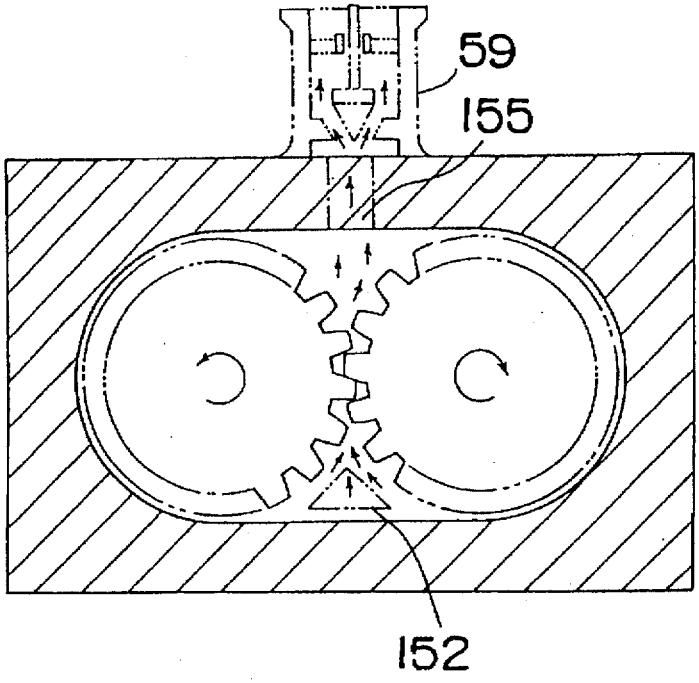
FIG. 13 is a plan view showing a vacuum pump according to a seventh embodiment of the present invention, which is similar to the fourth embodiment but includes a gear pump.
Figure 14:
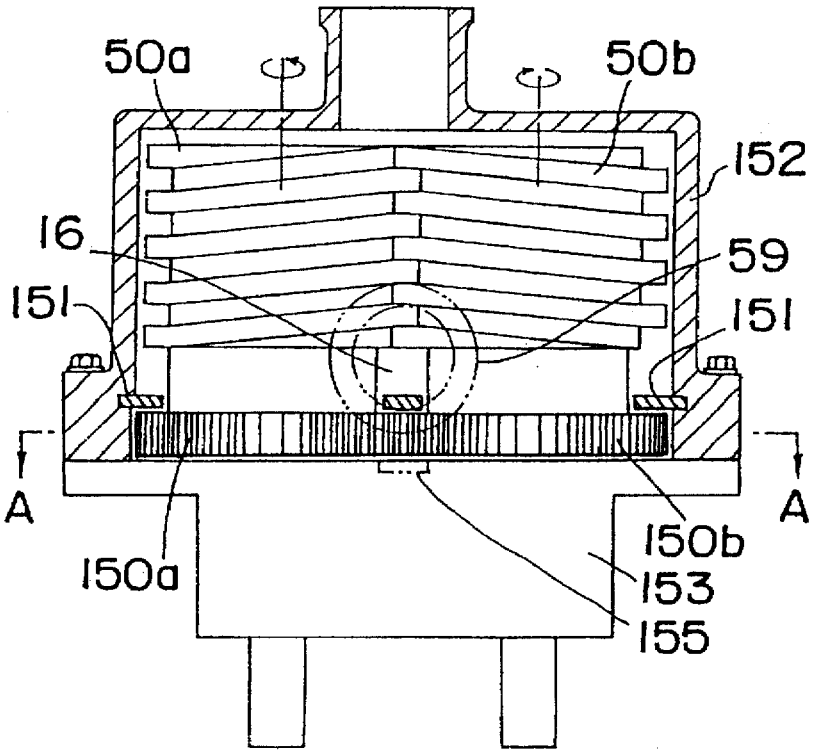
FIG. 14 is a sectional view showing the vacuum pump according to the seventh embodiment.
Figure 15:
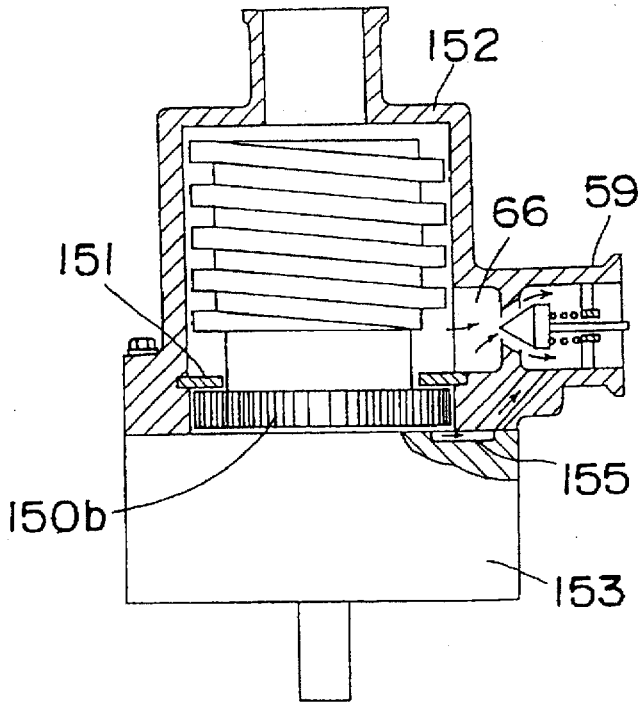
FIG. 15 is a sectional side elevation showing the vacuum pump according to the seventh embodiment.

The seventh embodiment is described below with reference to FIGS. 13 through 15 in which timing gears required to rotate two rotors synchronously are used as a second pump section (gear pump) to simplify the construction of the vacuum pump greatly. More specifically, two gears 150*a* and 150*b* serving as the second pump section transport a slight amount of gas under pressure as shown by arrows of FIG. 13, thus reducing the pressure in the exhaust side (gap 66) of the first pump section, as well as serving as timing gears, namely, preventing two rotors 50*a* and 50*b* from contacting each other in the synchronous rotation thereof. The vacuum pump comprises an upper cover 151 of the gears 150*a* and 150*b*; an upper housing 152; a lower housing 153; a second suction opening 152 formed on the upper cover 151; and a second exhaust opening 155 formed on the lower housing 153 and the upper housing 152.

Eighth Embodiment

Figure 16:
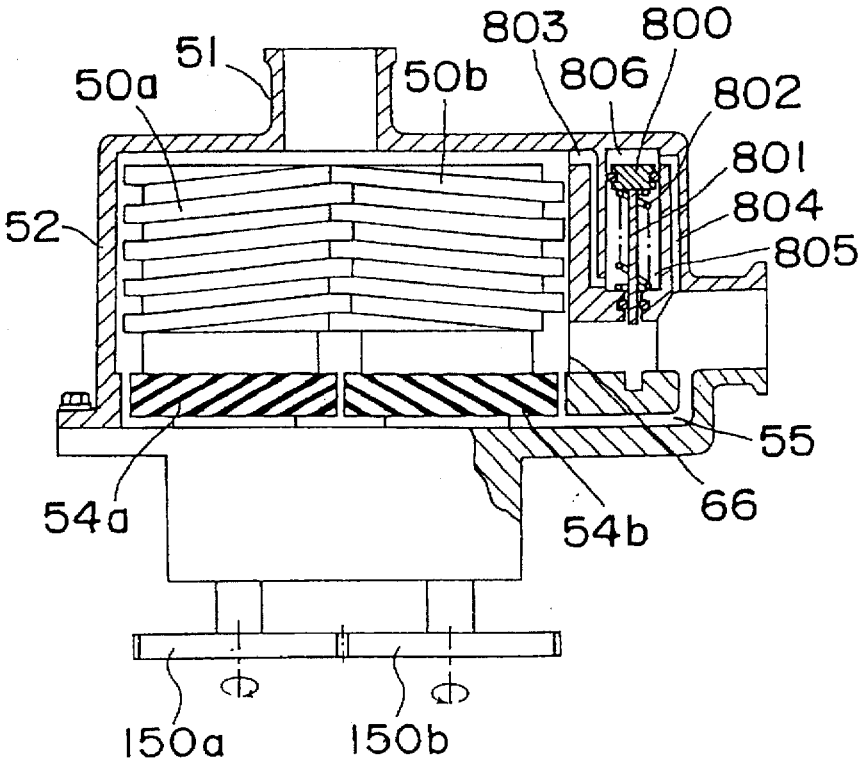
FIG. 16 is a view showing a vacuum pump according to an eighth embodiment of the present invention, which is similar to the fifth embodiment but includes a piston type gate valve shown in the open position.
Figure 17:
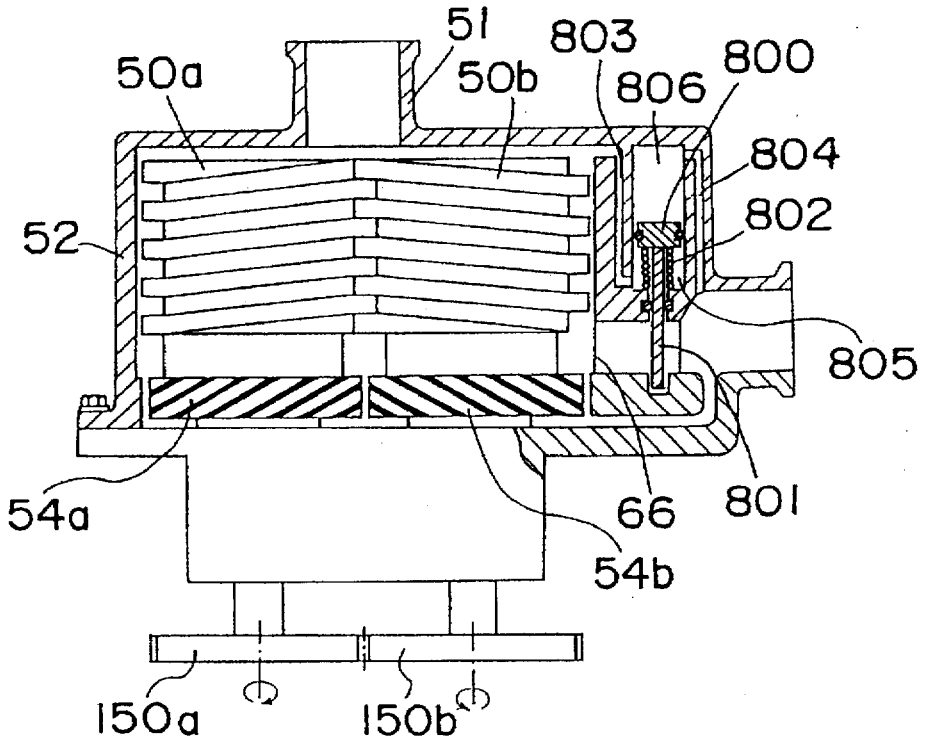
FIG. 17 is a view showing the vacuum pump of FIG. 16, in which the gate valve closed.

An evacuating apparatus according to the eighth embodiment is described below with reference to FIGS. 16 and 17. In the eighth embodiment, in order to reduce passage resistance, a piston-driven control valve is used and has the function of opening and closing a gate. FIG. 16 shows the state in which the pressure on the suction side of the pump is high and hence the valve is opened. FIG. 17 shows the state in which the pressure on the suction side of the pump is low and hence the valve is closed. The evacuating apparatus comprises a piston 800; a gate 801 for opening and closing an exhaust passage; a spring 802; a flow passage 803 communicating the suction side of the first pump section with a lower piston chamber 805; and a flow passage 804 communicating the exhaust side of the first pump section with an upper piston chamber 806.

Ninth Embodiment

Figure 18:
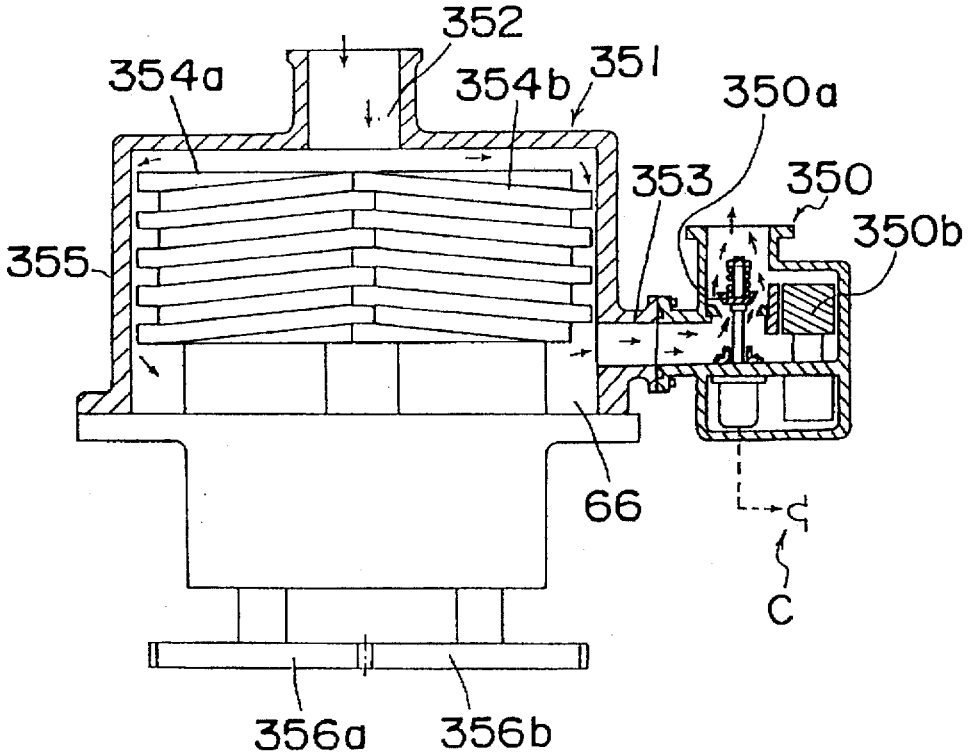
FIG. 18 is a view showing a vacuum pump according to a ninth embodiment of the present invention shown with a valve open.
Figure 19A:
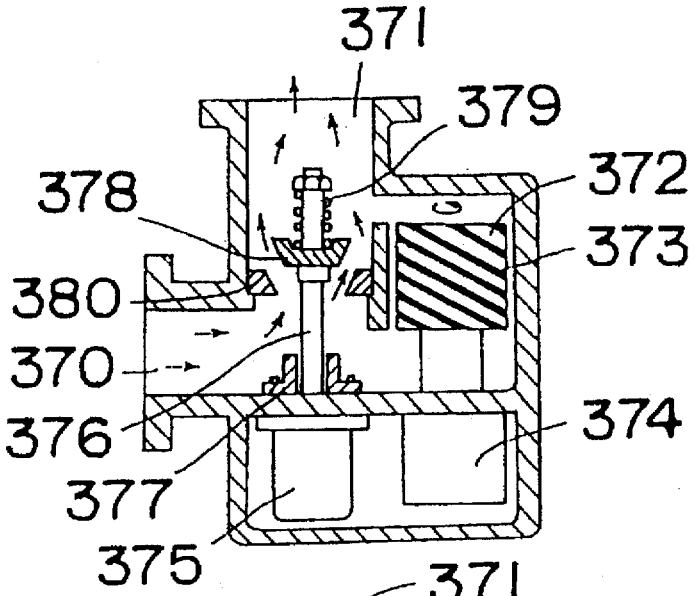
FIG. 19A is a view showing the vacuum pump of FIG. 18 in which the valve is open.
Figure 19B:
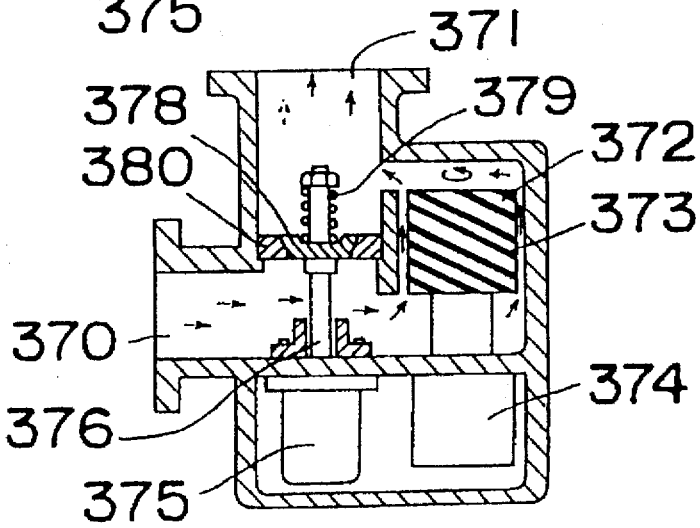
FIG. 19B is a view showing the vacuum pump of FIG. 18 in which the valve is closed.
Figure 19C:
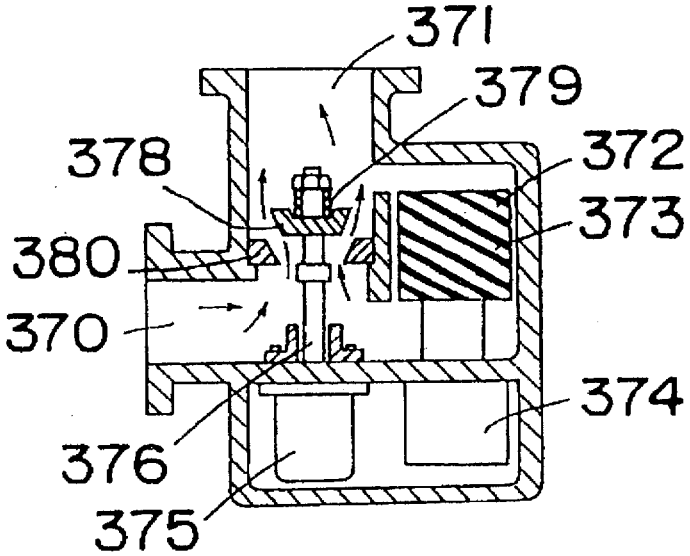
FIG. 19C is a view showing the vacuum pump of FIG. 18 in which the valve is opened in emergency.

An evacuating apparatus according to the ninth embodiment is described below with reference to FIG. 18. The evacuating apparatus comprises units, one of which is the conventional vacuum pump, in order to provide the effects of the present invention: reducing power to be consumed, improving ultimate degree of vacuum, and reducing noise. A control unit 350 accommodates a control valve 350*a* and a second pump section (micro-pump) 350*b*. In order to obtain the effects of the present invention without greatly improving the internal construction of the conventional vacuum pump, the control unit 350 accommodating the control valve 350*a* and the second pump section (micro-pump) 350*b* is disposed adjacent to the conventional vacuum pump so that the suction opening of the control unit 350 is connected with the exhaust opening of the conventional vacuum pump. The conventional screw type vacuum pump 351 comprises a suction opening 352; an exhaust opening 353; rotors 354*a* and 354*b* with thread grooves; a housing 355; and timing gears 356*a* and 356*b*. FIGS. 19A, 19B, and 19C show the details of the control unit 350. FIG. 19A shows a state in which exhaust has just started and 19B shows a state in which a sufficiently low degree of vacuum is obtained on the suction side. The control unit 350 comprises a suction opening 370 connected to the exhaust opening 353; an exhaust opening 371; a viscous-type pump 372 comprising a spiral groove formed on a rotor 373 and serving as the second pump section 350*b*; a motor 374 for driving the rotor 373; an electromagnetic solenoid 375; a rod 376 of the electromagnetic solenoid 375; a bush 377 for supporting a linear motion of the rod 376; a spool 378 disposed in an intermediate portion of the rod 376; and a seat 380 of the spool 378. The spool 378 slidably disposed on the rod 376 is urged in one direction by a compression spring 379. In the ninth embodiment, the electromagnetic solenoid 375 is driven by a signal (C in FIG. 18) outputted from a pressure sensor installed on the suction side (or inside vacuum chamber) of the vacuum pump, thus opening and closing the control valve 350*a*.

When the suction side of the vacuum pump is suddenly opened to the atmospheric air, the control valve 350*a* is opened because the spring 379 urging the spool 378 in one direction is compressed irrespective of the application state of the electric current flowing through the electromagnetic solenoid 375, as shown in FIG. 19C. Thus, the pump can be prevented from being damaged in case of emergency.

As described above, since the second pump section 350*b* and the valve 350*a* are constituted as a unit, the rotor diameter of the second pump section can be reduced and hence the second pump section can be operated at a high speed. Further, the clearance between the rotor and its housing can be reduced and thus an improved ultimate vacuum of the second pump section can be obtained. The second pump section can be operated at a higher speed by using a non-contact bearing such as a hydro-dynamic bearing, a magnetic bearing or the like as a bearing supporting the rotor 373.

Although the control unit 350 accommodates the control valve 350*a*, the provision of the control valve 350*a* may be omitted if the volume of the vacuum chamber is sufficiently small and if it is unlikely that the suction side of the vacuum pump will be opened to the atmospheric air.

Tenth Embodiment

Figure 20:
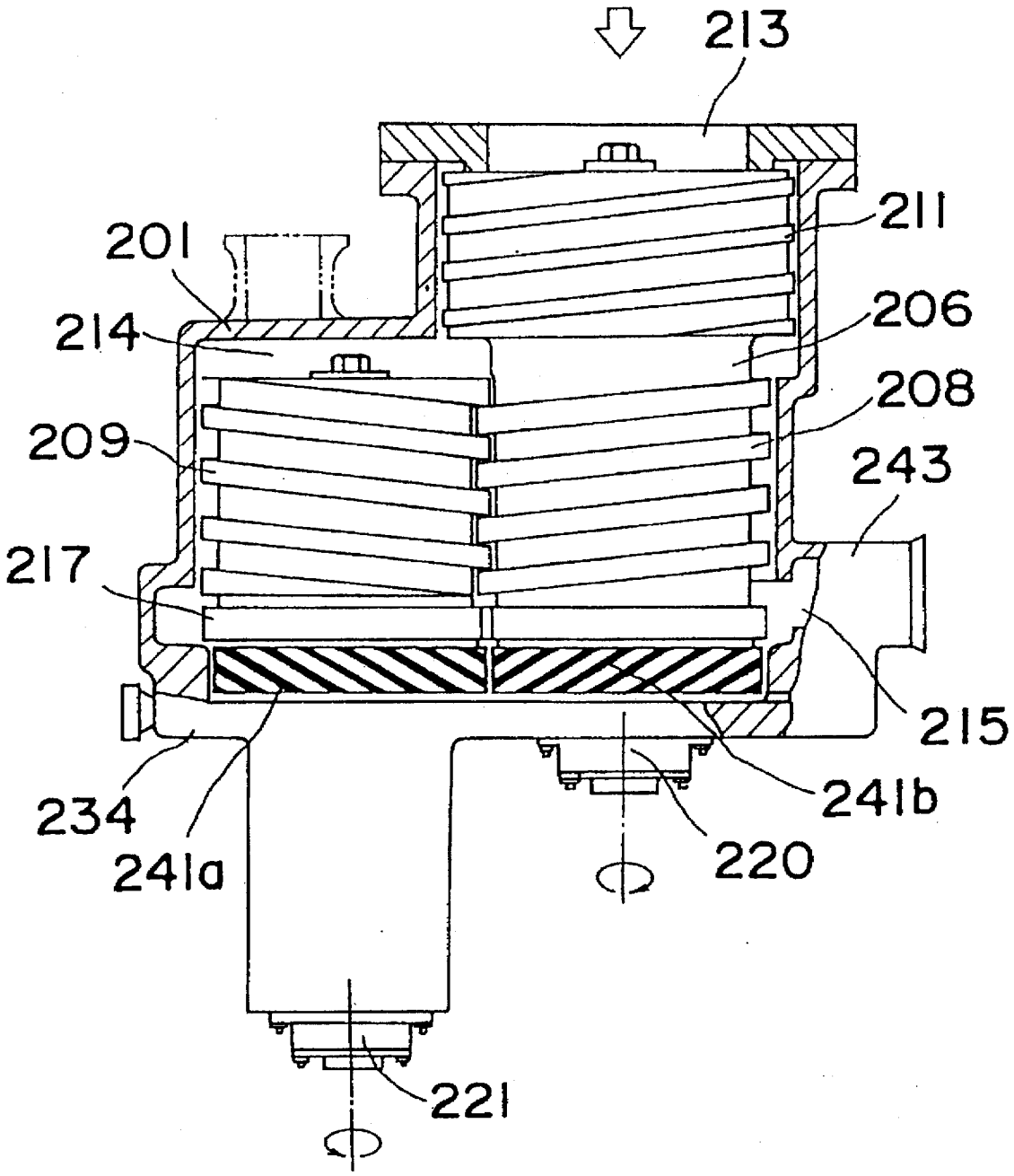
FIG. 20 is a view showing a non-contact and synchronous control type vacuum pump according to a tenth embodiment.
Figure 21:
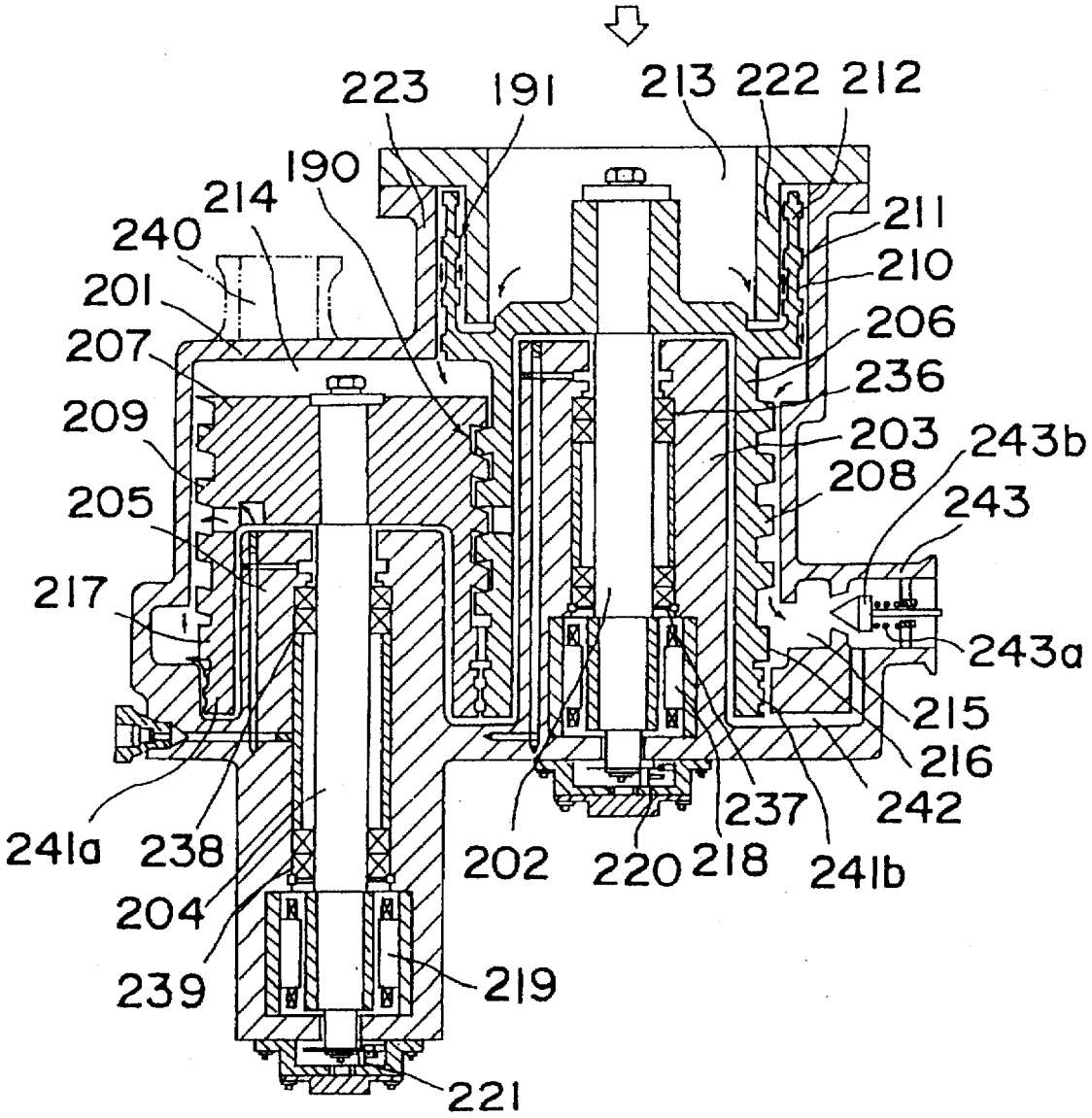
FIG. 21 is a sectional view showing the vacuum pump of FIG. 20.

An evacuating apparatus according to the tenth embodiment is described below with reference to FIGS. 20 and 21. In this embodiment, the evacuating apparatus is applied to a broad-band vacuum pump in which a pair of rotors rotate synchronously without contact.

The present inventors proposed a vacuum pump comprising a plurality of rotors; a plurality of motors; and detecting means. Each rotor is driven by an independent motor synchronously rotated without contact. The detecting means such as a rotary encoder is used to detect the rotational angle of each motor and the number of rotations thereof. This vacuum pump may be used as a roughing pump which is maintenance-free, clean, compact, space-saving and in addition, the rotors rotate at a high speed. A broad-band vacuum pump which produces from the atmospheric pressure to a high degree of vacuum can be obtained by providing a pump producing a high degree of vacuum on the shaft of one of the rotors of the vacuum pump proposed by the present inventors.

Figure 22:
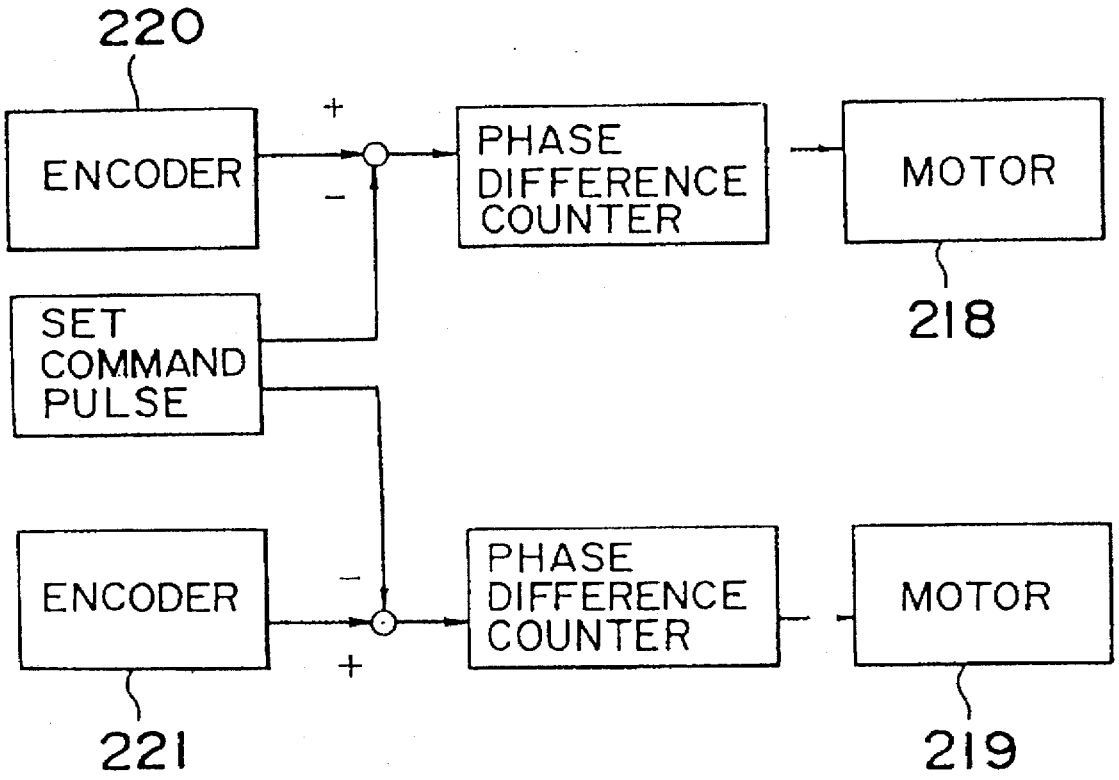
FIG. 22 is a block diagram showing an electronic control means used to perform the synchronous rotation of rotors.
Figure 23:
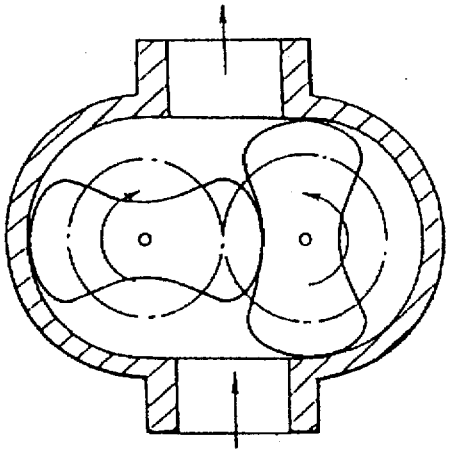
FIG. 23 is a view showing claw type rotors which can be applied to the vacuum pump of the present invention.
Figure 25:
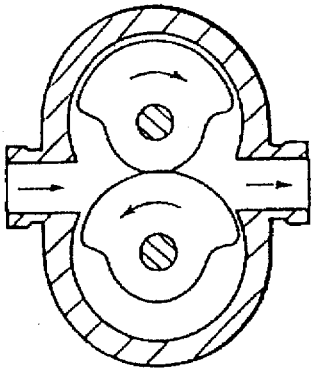
FIG. 25 is a view showing rotors with a particular configuration which can be applied to the vacuum pump of the present invention.
Figure 24:
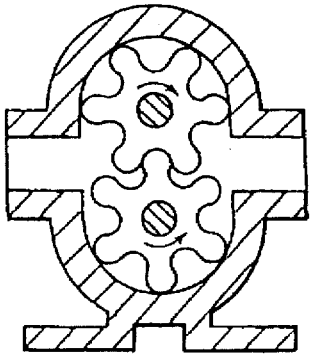
FIG. 24 is a view showing gear type rotors which can be applied to the vacuum pump of the present invention.
Figure 27:
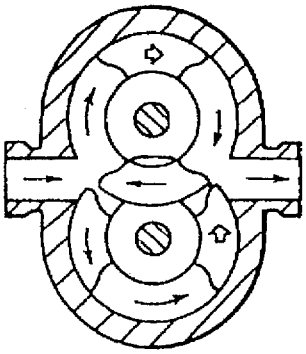
FIG. 27 is a view showing rotors with another particular configuration which can be applied to the vacuum pump of the present invention.
Figure 26:
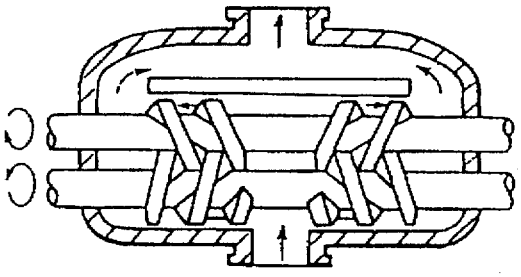
FIG. 26 is a view showing screw type rotors with a particular configuration which can be applied to the vacuum pump of the present invention.
Figure 28:
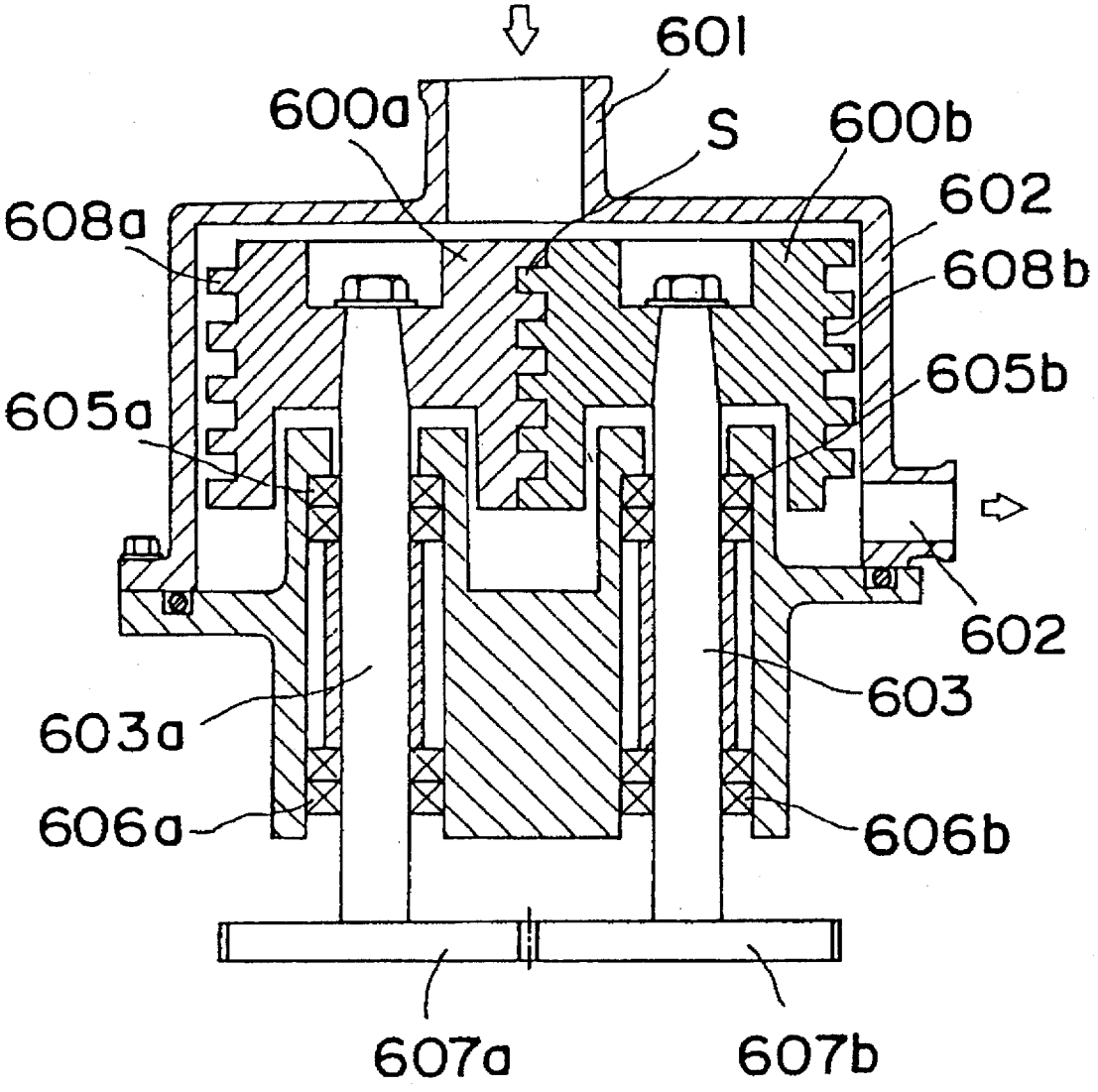
Fig. 28 PRIOR ART
FIG. 28 is a sectional view showing a conventional screw type vacuum pump.
Figure 29A:
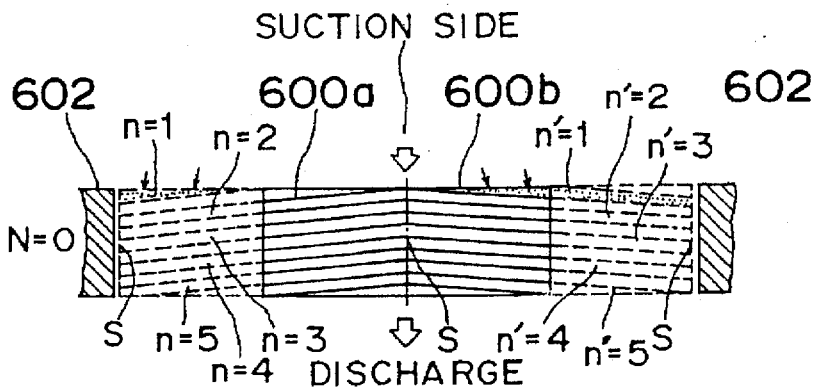
Fig. 29A PRIOR ART
FIGS. 29A, 29B, and 29C are model views showing the processes of suction, transportation, and exhaust of a conventional screw pump.
Figure 29B:
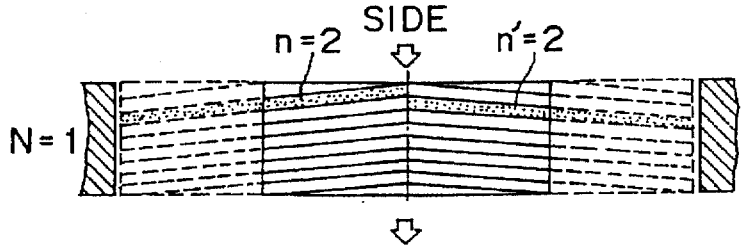
Fig. 29B PRIOR ART
Figure 29C:
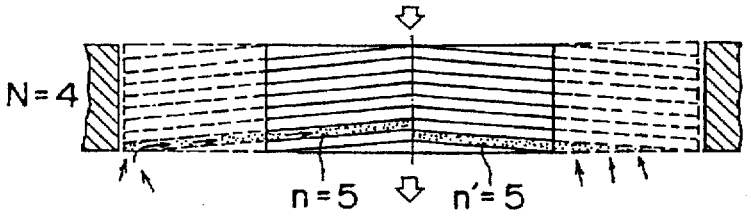
Fig. 29C PRIOR ART
Figure 30:
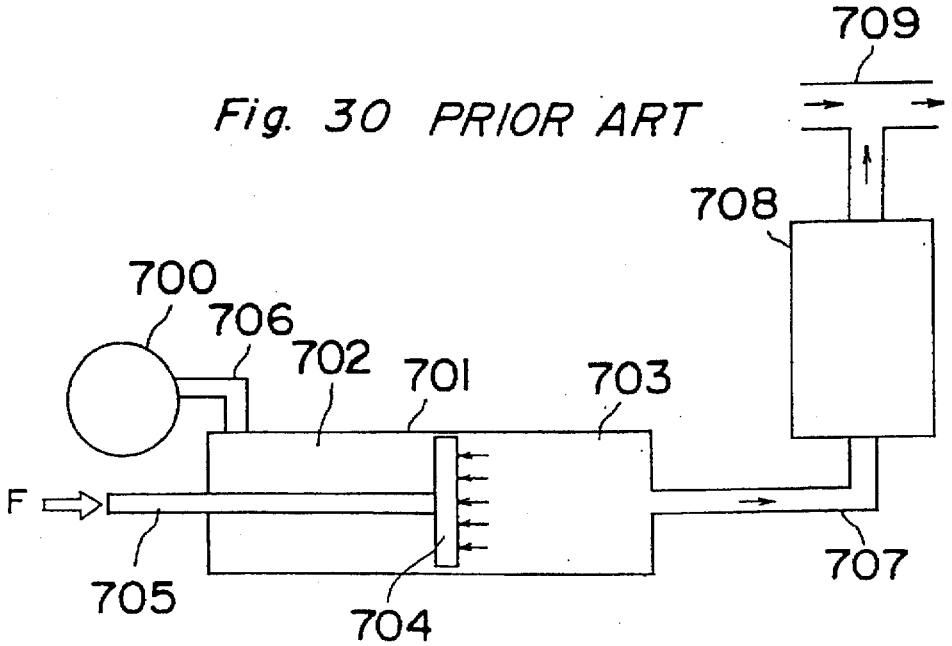
Fig. 30 PRIOR ART
FIG. 30 is a model view showing a conventional vacuum pump.

The vacuum pump proposed by the present inventors can be greatly improved as follows by applying the evacuating apparatus of the present invention thereto. The vacuum pump comprises a housing 201; a first fixed sleeve 203 accommodating a first rotary shaft 202 vertically; a second fixed sleeve 205 accommodating a second rotary shaft 204 vertically; and cylindrical rotors 206 and 207 disposed coaxially with the each of the rotary shafts 202 and 204. The rotary shafts 202 and 204 are supported by each of a pair of ball bearings 236 and 237 and a pair of bearings 238 and 239. Thread grooves 208 and 209 serving as fluid-transporting grooves and engaging each other are formed on the peripheral surfaces of the rotors 206 and 207. The engaging portion of each of the thread grooves 208 and 209 serves as the structure section 190 (first pump section) of a positive displacement type vacuum pump. A cylindrical rotary sleeve 210 integrally connected with the rotor 206 is disposed on an upper portion of the first rotary shaft 202. Fixed cylinders 222 and 223 are disposed on the casing 201 so that the rotary sleeve 210 is accommodated between the fixed cylinders 222 and 223 in one direction. Spiral drag grooves 211 and 212 are formed on the moving inside and outside surfaces of the rotary sleeve 210. The portion formed of the sleeve 210 and the fixed cylinders 222 and 223 is denoted as a structure section 191 (third pump section) of a drag pump for evacuating the vacuum chamber from an intermediate to a high degree of vacuum. The third pump section has a function of exhausting gas mainly in a molecular flow region or an intermediate flow region. That is, due to the drag action of the spiral grooves 211 and 212, gas which has flowed from a suction opening 213 disposed on a high degree of vacuum side is exhausted to a space 214 accommodating the positive displacement type screw vacuum pump. The gas which has flowed into the positive displacement type screw vacuum pump is exhausted from a discharge opening 215. It is possible to draw gas from a suction opening 240 (shown by two-dot chain line) of a positive displacement type vacuum pump when the pressure in the vacuum chamber is close to the atmospheric pressure after the pump is actuated and then draw gas from the suction opening 213 when the pressure in the vacuum chamber has approached a vacuum pressure. Contact preventing gears 216 and 217 for preventing the contact between the thread grooves are formed on the peripheral surface of the lower end of each of the rotors 206 and 207. A solid lubricating film is formed on the gears 216 and 217 so as to withstand some friction between metals. The backlash between the engaging portion of the gears 216 and 217 is set to be smaller than that of the engaging portion of the thread grooves 208 and 209 formed on the peripheral surfaces of the rotors 206 and 207. Accordingly, the gears 216 and 217 do not contact each other when the rotary shafts 202 and 204 are synchronously rotating, while if the rotary shafts 202 and 204 are non-synchronously rotating, the gears 216 and 217 contact each other before the thread grooves 208 and 209 contact each other. In this manner, the thread grooves 208 and 209 can be prevented from contacting each other. The gears 216 and 217 may be used as the second pump section (gear pump) as shown in the embodiment described with reference to FIGS. 13 through 15. This construction may eliminate the provision of the viscous-type pumps 241*a* and 241*b* constituted by the spiral groove which will be described later. The first rotary shaft 202 and the second rotary shaft 204 are rotated at a speed as fast as several tens of thousands of revolutions per minute by AC servo-motors 218 and 219 disposed at lower portions of the rotary shafts 202 and 204. The control of the synchronous rotation of the rotary shafts 202 and 204 is accomplished as follows: Rotary encoders 220 and 221 are disposed at the lower ends of the rotary shafts 202 and 204. Pulses outputted from the rotary encoders 220 and 221 are compared with a predetermined instruction pulse (target value) of a virtual rotor as shown by the block diagram of FIG. 22. The deviation between the target value and the values (number of rotations and rotational angle) outputted from each of the rotary shafts 201 and 204 are calculated by each phase difference counter, and the rotation of each of the servo-motors 218 and 219 disposed on the rotary shafts 202 and 204 is controlled to erase the deviation. In this embodiment, a laser type encoder utilizing the diffraction and interference of a laser beam and having high resolution and high response is used instead of a magnetic encoder or an optical encoder.

The evacuating apparatus further comprises second pump sections 241*a* and 241*b*, of a viscous type pump, formed coaxially with the rotors 206 and 207; a second exhaust opening 242; a control valve 243 constituted by a spring 243*a*, a spool 243*b*, and the like.

Eleventh Embodiment

Figure 31:
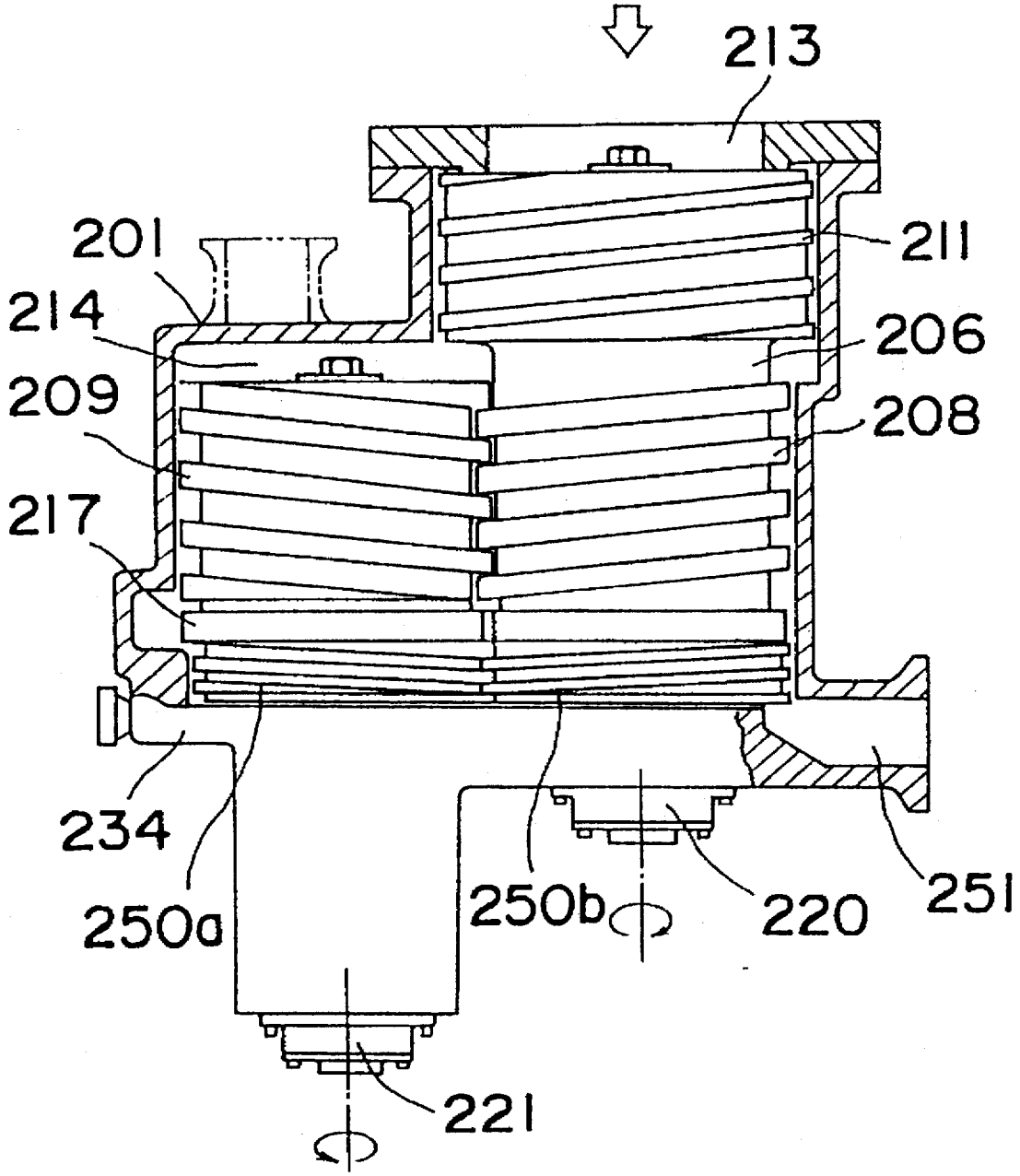
FIG. 31 is a sectional view showing a vacuum pump according to an eleventh embodiment of the present invention.

The eleventh embodiment is described below with reference to FIG. 31. In the vacuum pump according to the eleventh embodiment, a positive displacement type screw (thread groove) pump is used as the second pump section of the tenth embodiment and the control valve is not provided. The vacuum pump comprises microscrews 250*a* and 250*b* and an exhaust opening 251.

The following effects are obtained when the evacuating apparatus according to the embodiments of the present invention is applied to a vacuum pump in which two rotors are rotated synchronously by an electronic means:

(Effect 1) High speed operation allows vacuum pump to be driven by a small amount of power.

Most of the power required to drive the vacuum pump of the embodiment is determined by the torque required to drive the first pump section as described previously. The lower the pressure in vacuum on the downstream side (upstream side of second pump section) of the first pump section is, the smaller torque is required.

The smaller the ratio of (inner leakage/exhaust capability) is, the smaller the vacuum pressure can be generated on the upstream side of the second pump section.

(Effect 2) High speed operation generates low ultimate vacuum.

In the structure portion 191 (third pump section) of the drag pump, the rotary portion (sleeve 210) rotates in a low pressure space when the pressure in the suction side 213 has reached a low degree of vacuum pressure. Therefore, a small load due to the pressure is applied to the vacuum pump and thus torque required to drive the first pump section becomes small. Utilizing this point, the pump of this embodiment accomplishes the following operations.

(Operation 1) First, the vacuum pump is driven at approximately 10,000 rpm and the positive displacement type first pump section is fully operated to reduce the pressure in the vacuum chamber to as low as $10^{-2}$ to $10^{-3}$ torr.

(Operation 2) When the operation 1 has been completed, the pressure in the downstream side of the first pump section (screw pump) has become sufficiently low. Therefore, the power consumed by the motor is very small. Then, the number of rotations of the vacuum pump is increased to, for example, 20,000 to 30,000 rpm. The vacuum pump can be rotated at a high speed even by a small motor because of the reduction of the required torque. As a result, the exhaust efficiency of the pump 191 (third pump section) of kinetic type is increased and consequently, the ultimate vacuum can be reduced to as low as equal to or less than $10^{-8}$ torr.

(Effect 3) A broad-band vacuum pump can be installed directly on a vacuum chamber in a semiconductor-manufacturing factory.

In a conventional semiconductor factory, a roughing pump and a turbo-molecular pump are installed in separate chambers and connected to each other by a pipeline. The roughing pump is controlled in an exclusive room so that frequent maintenance operations can be efficiently performed because the roughing pump generates great vibration, exhaust sound, namely, exhaust noise, and heat quantity in exhaust. In the turbo-molecular pump which generates little vibration and noise, conductance is increased by directly installing the turbo-molecular pump on the vacuum chamber so as to obtain a low degree of vacuum. The vacuum pump of the present invention has the effect of the conventionally proposed vacuum pump in which the two rotors rotate synchronously without contact. That is, the vacuum pump allows the evacuating apparatus of the present invention to be clean, reduce vibration, and operate at a high speed, thus being compact and light. In addition, since the vacuum pump of the present invention generates low noise and a small torque is required to drive the first pump section of the vacuum pump, a small heat quantity is generated in exhaust. Accordingly, in the vacuum pump of the present invention, the roughing-pump and the conventional turbo-molecular pump are combined with each other, and in addition, instead of the turbo-molecular pump, the vacuum pump can be installed directly on the vacuum chamber. It is very difficult to form this construction by the vacuum pump, in which two rotors are synchronously rotated by the electronic means, proposed by the present inventors. The present invention may fundamentally change the conventional manufacturing concept of semiconductor-manufacturing factory.

In the embodiments of the present invention, the screw pump with a thread groove is used as the first pump section. But (claw, gear, screw) pumps comprising rotors of various types as shown in FIGS. 23 through 27 may be used as the first pump section. In addition, a centrifugal pump or a viscous type pump comprising one rotor may be used as the first pump section.

In the viscous type pump used as the second pump section of the embodiments, a shallow spiral groove is formed on the surface of the rotor, but may be formed on the stationary portion of the housing opposed to the rotor. Further, the viscous type pump may be in a configuration other than a cylindrical configuration. For example, a plurality of thrust disks can be superimposed on each other and grooves are formed on the surfaces of the disks so that fluid flows radially.

The second pump sections of all the above-described embodiments can be synchronously rotated by electronic means. For example, the micro-screw of positive displacement type according to the second embodiment can be applied to the second pump section. If the volume of the vacuum chamber is sufficiently small, the third embodiment in which the provision of the control valve 243 is omitted can be applied to the synchronous rotation (see, for example, FIG. 7B).

Figure 8B:
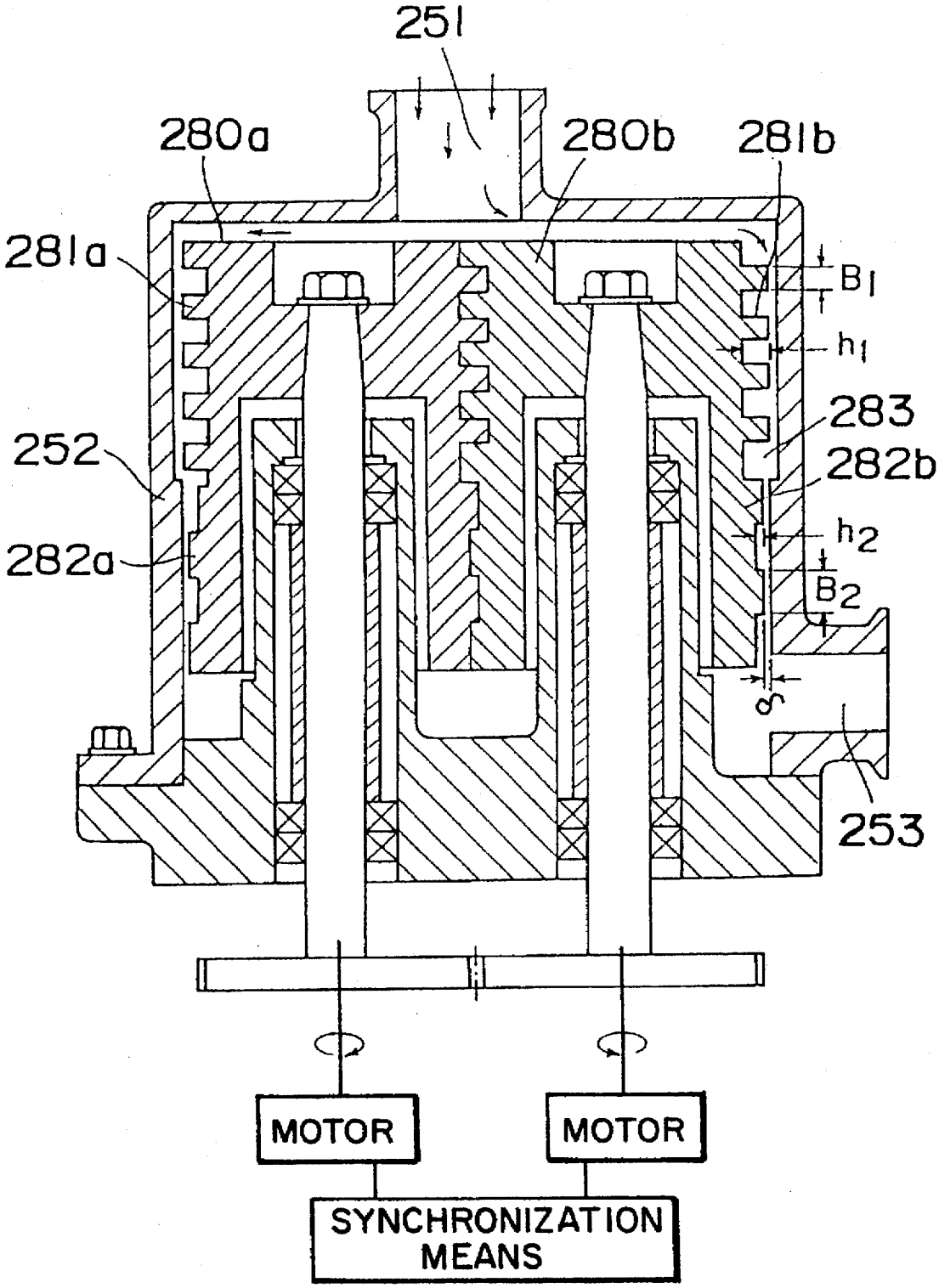
FIG. 8B is a view similar to FIG. 8A but showing the vacuum pump provided with electronic synchronizing.
Figure 9B:
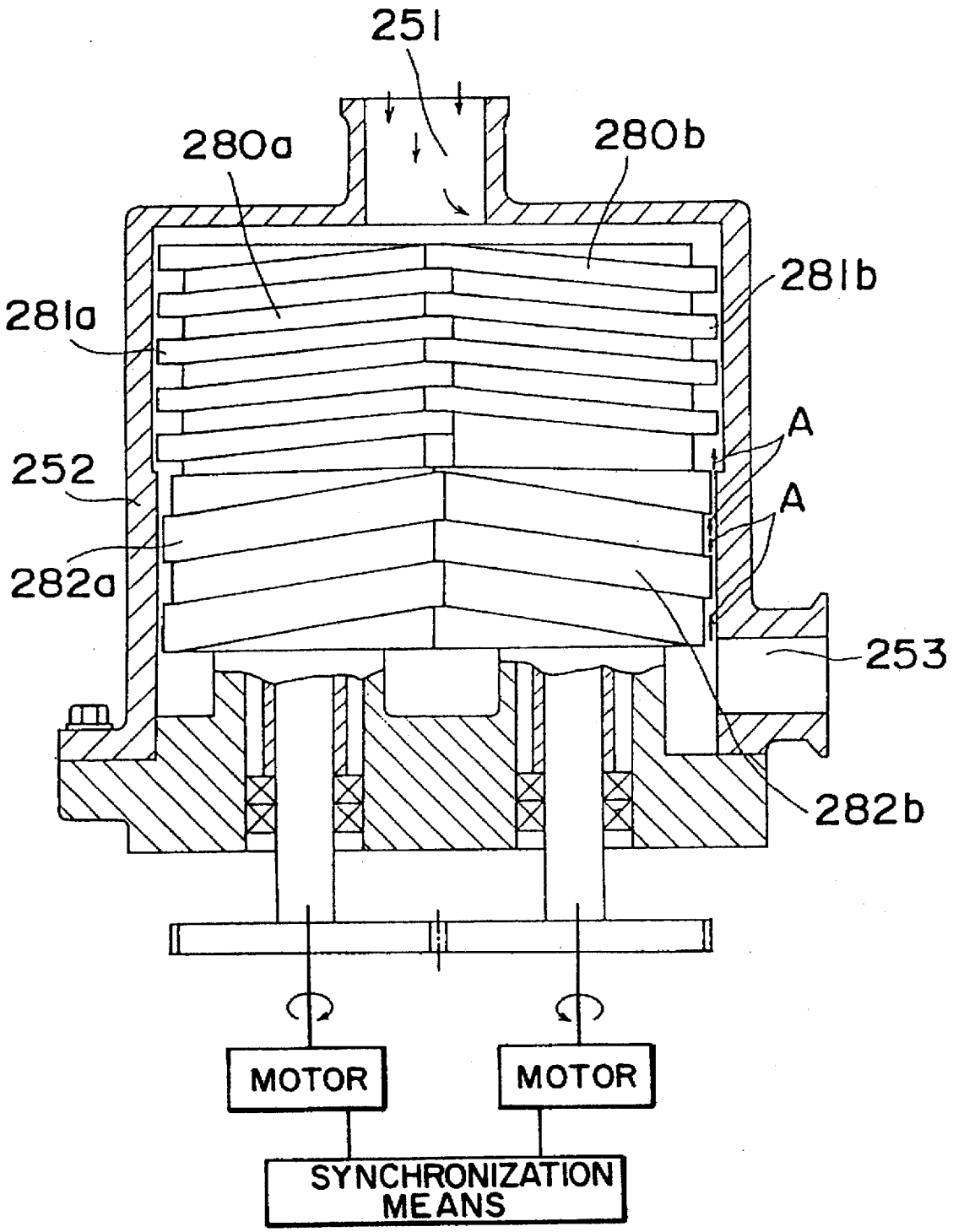
FIG. 9B is a view similar to FIG. 9A but showing the vacuum pump provided with electronic synchronization.

Alternatively, the second pump sections of the fourth or fifth embodiment can be synchronously rotated (see, for example, FIGS. 8B and 9B) to improve sealing performance in the fourth embodiment or to allow the length of the rotor to be shortened in the fifth embodiment.

The pumps shown in FIGS. 23 through 27 can be selected in conformity to the use of the second pump section.

The evacuating apparatus according to the present invention comprises the first pump section providing a large amount of exhaust amount and the second pump section having a small exhaust amount but providing a sufficiently low degree of vacuum which are combined with each other. The following effects can be obtained by using the vacuum pump in the evacuating system of semiconductor-manufacturing equipment:

[I] A great amount of energy can be saved during a steady drive of the vacuum pump.

The driving torque of the pump is proportional to the theoretical exhaust volume of the vacuum pump. Therefore, when the pressure on the suction side has reached a low pressure, the torque of the first pump section can be greatly reduced. The second pump section provides a sufficiently low degree of vacuum and exhausts a slight amount of gas, and thus a small torque is required to drive the second pump section. Thus, a greatly reduced power suffices for driving the vacuum pump.

[II] Vacuum pump provides a very low degree of vacuum.

In the vacuum pump, an exhaust amount is disproportional to an ultimate degree of vacuum. If a large exhaust amount is to be obtained, a favorable ultimate degree of vacuum cannot be obtained. If a desired degree of vacuum is to be obtained, the exhaust amount becomes small. The present invention is characterized in that two pumps having different properties are combined with each other:

(1) First pump section (upstream pump section) providing a large amount of exhaust; and (2) Second pump section (downstream pump section) having a small exhaust amount but providing a low degree of vacuum.

In the vacuum pump, a large passage area can be formed in the exhaust side by providing a sufficiently large exhaust opening between the first pump section and the second pump section, and thus the exhaust amount may be not limited. When the pressure on the suction side has reached a low degree of vacuum, the exhaust opening is closed and the first pump section and the second pump section communicate with each other. Due to the existence of the second pump section, the pressure on the exhaust side of the first pump section becomes sufficiently small. As a result, the leakage of a high pressure gas of the first pump section toward the upstream side is decreased. That is, in the evacuating apparatus of the present invention, a high ultimate degree of vacuum can be obtained by the effects generated by the combination of the first and second pump sections.

When the volume of the vacuum chamber connected with the suction side of the pump is sufficiently small, it is unnecessary to provide the valve and the exhaust opening between the first and second pump sections. Thus, the construction of the vacuum pump is simple.

The first and second pump sections are not necessarily independent pump sections. For example, the entire length of the rotor can be shortened by using a positive displacement type pump in which thread grooves (or screw curves) continuously change.

[III] A further improved noise reduction can be obtained by synchronously rotating rotors by electronic control means.

The effect of the present invention can be obtained by combining the first pump section, previously proposed by the present inventors, driven by the electronic control means for the synchronous rotation of the rotors and the second pump section according to the present invention with each other. One of the reasons is that the number of rotations of the pump can be greatly increased by the electronic control means used to perform the synchronous rotation of the rotors.

For example, the pump composed of the combined pump sections according to the conventional art and the present invention can be rotated tens of thousands of times per minute whereas the conventional first pump section is rotated thousands of times per minute. As a result, the following effects can be obtained:

(1) The internal leakage of gas from the exhaust side of the pump to the upstream side thereof can be reduced and thus the vacuum pressure of the second pump section can make lower on the upstream side thereof, thus making torque required for driving the pump lower.

(2) The ultimate degree of vacuum of the first pump section can be made lower due to the high speed drive of the pump. A vacuum pressure as low as $10^{-8}$ Torr can be generated by a composite pump in which the first pump section is combined with a drag pump (third pump section), because the exhaust pressure of the drag pump is very low.

Further, in addition to the electronic control performing the synchronous rotation of the rotors with no noise generated from the contact between the timing gears, noise can be further prevented for the following reasons. That is, according to the vacuum pump of the present invention, the rotors of the first pump section having a great exhaust amount rotate in a space having a low pressure both in the exhaust side and the suction side. Consequently, no noise is generated by the rotation of rotors in a particular configuration, for example, a screw configuration. In addition, the back flow of gas from the exhaust side of the pump to the interior thereof does not occur or no re-outflow occurs and hence no pulsation sound is generated.

Accordingly, the pump according to the present invention can greatly reduce the generation of noise than the conventional roughing pump by 10 to 20 dB.

The above effect can be obtained by the pump comprising the construction of the present invention combined with the pump having the electronic control means proposed previously by the present inventors. A vacuum pump providing a high degree of vacuum can be provided on the shaft of one of the rotors so as to obtain a compact pump which generates quiet sound, a small amount of heat, and a vacuum pressure over a broad band.

The above-described effects of the present invention allow a semiconductor-manufacturing factory to have efficiency in operation.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. An evacuating apparatus comprising:

a housing having a fluid suction opening and at least one fluid exhaust opening;

a first pump section mounted in said housing and having a suction side and an exhaust side;

a second pump section, having a suction side and an exhaust side and being mounted in said housing on the exhaust side of said first pump section, for exhausting a smaller amount of fluid than said first pump section;

wherein said first and second pump sections comprise a plurality of rotors accommodated in said housing;

wherein bearings are mounted in said housing and rotatably support said rotors;

wherein said first pump section comprises a positive displacement pump which positively displaces fluid by utilizing a volume change of a space defined by said rotors and said housing;

wherein said second pump section comprises a positive displacement pump which positively displaces fluid by utilizing a volume change of a space defined by said rotors and said housing;

wherein a plurality of motors are operably coupled to said rotors, respectively, and said motors are electronically controlled for synchronizing rotation of said rotors.

2. An evacuating apparatus as recited in claim 1, wherein each of said first and second pump sections comprises a pair of said rotors.

3. An evacuating apparatus as recited in claim 1, wherein said at least one fluid exhaust opening comprises a first fluid exhaust opening disposed on said exhaust side of said first pump section and said suction side of said second pump section, and a second fluid exhaust opening disposed on said exhaust side of said second pump section.

4. An evacuating apparatus as recited in claim 3, further comprising a valve for opening and closing said first fluid exhaust opening.

5. An evacuating apparatus as recited in claim 4, wherein said valve comprises a check valve.

6. An evacuating apparatus as recited in claim 4, wherein said valve comprises a piston-driven control valve.

7. An evacuating apparatus as recited in claim 1, wherein said first pump section comprises a pair of rotors having respectively interengaging thread grooves;

said second pump section comprises a pair of rotors having respectively interengaging thread grooves; and the following equations are satisfied:

$$B_2 \geqq B_1; \text{ and}$$

$$h_1 \geqq h_2;$$

wherein $B_1$ is an average width of the thread grooves formed on said rotors of said first pump section, $B_2$ is an average width of the thread grooves formed on said rotors of said second pump section, $h_1$ is an average depth of the thread grooves formed on said rotors of said first pump section, and $h_2$ is an average depth of the thread grooves formed on said rotors of said second pump section.

8. An evacuating apparatus as recited in claim 1, wherein said rotors are respectively provided with thread grooves which have pitches that decrease in a direction from said suction side of said first pump section to an exhaust side of said second pump section;

said first pump section comprises upper portions of said rotors, respectively; and said second pump section comprises lower portions of said rotors, respectively.

9. An evacuating apparatus as recited in claim 1, further comprising a third pump section, formed by at least one screw thread or a vane fixed for rotation with at least one of said rotors, for exhausting gas in molecular and intermediate flow regions.

10. An evacuating apparatus as recited in claim 1, further comprising a sub-pump provided in said housing on the exhaust side of said second pump section for transporting fluid under pressure in a direction opposite the direction in which said second pump section transports fluid.

11. An evacuating apparatus as recited in claim 1, wherein an electronic synchronizing means is provided to cause synchronization of said rotors by synchronizing operation of said motors, respectively.

12. An evacuating apparatus as recited in claim 1, wherein said second pump section comprises a pair of interengaged timing gears.

13. An evacuating apparatus as recited in claim 1, further comprising a pair of interengaged timing gears fixed for rotation with said rotors, respectively.

14. An evacuating apparatus as recited in claim 1, wherein said rotors are not coupled for rotation with one another by mechanically interengaged timing gears.

15. An evacuating apparatus comprising:

a housing having a fluid suction opening and at least one fluid exhaust opening;

a first pump section mounted in said housing and having a suction side and an exhaust side;

a second pump section, having a suction side and an exhaust side and being mounted in said housing on the exhaust side of said first pump section, for exhausting a smaller amount of fluid than said first pump section;

wherein said first and second pump sections comprise a plurality of rotors accommodated in said housing;

wherein bearings are mounted in said housing and rotatably support said rotors;

wherein said first pump section comprises a positive displacement pump which positively displaces fluid by utilizing a volume change of a space defined by said rotors and said housing;

wherein said first pump section comprises a pair of rotors having respectively interengaging thread grooves;

wherein said second pump section comprises a pair of rotors having respectively interengaging thread grooves; and wherein the following equations are satisfied:

$$B_2>B_1; \text{ and}$$

$$h_1>h_2;$$

wherein $B_1$ is an average width of the thread grooves formed on said rotors of said first pump section, $B_2$ is an average width of the thread grooves formed on said rotors of said second pump section, $h_1$ is an average depth of the thread grooves formed on said rotors of said first pump section, and $h_2$ is an average depth of the thread grooves formed on said rotors of said second pump section.

* * * * *